US005101640A

United States Patent [19]

Fukushima et al.

[11] Patent Number: 5,101,640

[45] Date of Patent: Apr. 7, 1992

[54] AIR CONDITIONING APPARATUS, HEAT EXCHANGER FOR USE IN THE APPARATUS AND APPARATUS CONTROL METHOD

[75] Inventors: Toshihiko Fukushima, Tsuchiura; Seigo Miyamoto; Masanori Musoh, both of Katsuta; Tomomi Umeda; Takatoshi Yamamoto, both of Ibaraki, all of Japan

[73] Assignee: Hitachi, Ltd., Tokyo, Japan

[21] Appl. No.: 620,205

[22] Filed: Nov. 30, 1990

[30] Foreign Application Priority Data

Dec. 1, 1989 [JP] Japan ..... 1-310634

[51] Int. Cl.[5] ..... F25B 39/00

[52] U.S. Cl. ..... 62/196.4; 62/DIG. 17; 165/101

[58] Field of Search ..... 62/196.4, DIG. 17, 117, 62/506, 507; 165/101

[56] References Cited

U.S. PATENT DOCUMENTS

| | | | |
|---|---|---|---|
| 3,112,620 | 12/1963 | Stewart | 62/DIG. 17 |
| 3,368,364 | 2/1968 | Norton et al. | 62/DIG. 17 |
| 3,370,438 | 2/1968 | Hopkinson | 62/DIG. 17 |
| 3,481,152 | 12/1969 | Seeley | 62/196.4 |
| 3,487,642 | 1/1970 | Norton | 165/101 X |
| 3,789,919 | 2/1974 | Huber | 165/101 |
| 4,136,528 | 1/1979 | Vogel et al. | 62/DIG. 17 |

FOREIGN PATENT DOCUMENTS

| | | |
|---|---|---|
| 63-3191 | 1/1988 | Japan . |
| 63-4690 | 1/1988 | Japan . |
| 64-22171 | 2/1989 | Japan . |
| 64-54690 | 4/1989 | Japan . |

*Primary Examiner*—Harry B. Tanner
*Assistant Examiner*—John Sollecito
*Attorney, Agent, or Firm*—Antonelli, Terry, Stout & Kraus

[57] ABSTRACT

The present invention provides an air conditioning apparatus for automobiles equipped with a heat exchanger and a control method for the apparatus, by which the heat transfer area of the heat exchanger can be properly controlled to permit a stable cycle operation, even when the capacity of a condenser is relatively overly enhanced under a condition of the low atmospheric temperature. The apparatus and the control method are achieved with such an arrangement that either one or both of headers of a heat exchanger is provided with at least one refrigerant flow rate control valve capable of opening and closing refrigerant passages in each header, the heat exchanger has a refrigerant inlet provided in one header and a refrigerant outlet provided in the other header, and the control valve is opened and closed to change the number of the passages allowing the refrigerant to pass therethrough, for thereby changing the effective heat transfer area for heat exchange dependent on the atmospheric temperature.

12 Claims, 23 Drawing Sheets

| | | |
|---|---|---|
| (I) | 35a CLOSED<br>35b CLOSED |  |
| (II) | 35a CLOSED<br>35b OPEN |  |
| (III) | 35a OPEN<br>35b CLOSED |  |
| (IV) | 35a OPEN<br>35b OPEN |  |

| | | |
|---|---|---|
| (I) | 35a CLOSED<br>35b CLOSED |  |
| (II) | 35a CLOSED<br>35a OPEN |  |
| (III) | 35a OPEN<br>35b CLOSED |  |
| (IV) | 35a OPEN<br>35b OPEN |  |

| | | |
|---|---|---|
| (I) | 35a OPEN<br>35b OPEN |  |
| (II) | 35a OPEN<br>35b CLOSED |  |
| (III) | 35a CLOSED |  |

AIR CONDITIONING APPARATUS, HEAT EXCHANGER FOR USE IN THE APPARATUS AND APPARATUS CONTROL METHOD

BACKGROUND OF THE INVENTION

1. Field of the Invention

The present invention relates to an air conditioning apparatus, and more particularly to an air conditioning apparatus equipped with a heat exchanger which is suitable to control an amount of radiant heat from a condenser, and to a control method for the apparatus.

2. Prior Art

A heat exchanger used as a condenser for car air-conditioners was conventionally arranged by bending a perforated, extruded flat tube in the meandered or zigzag form, and disposing a number of fins between adjacent parallel portions of the zigzag tube. Because the above arrangement produces the increased pressure drops of a refrigerant flow, however, there has recently been practiced a heat exchanger comprising a number of heat conducting pipes arranged side by side between a pair of headers disposed parallel to each other for thereby reducing the pressure drops, as disclosed in Japanese Patent Unexamined Publication No. 63-3191 and Japanese Utility Model Unexamined Publication No. 64-22171 and No. 63-54690.

In the foregoing prior art, the heat transfer area of a heat exchanger is set to be capable of generating an amount of radiant heat necessary as a condenser even under a condition that the atmospheric temperature is high and the maximum cooling capacity is required in a refrigerating cycle. Thus, the heat transfer area of the heat exchanger is determined in anticipation of maximum load. Because the condenser is mounted in front of a radiator and cooled with the incoming air while an automobile is traveling, running conditions greatly change dependent on a vehicle speed. The temperature in compartments is also changed from about 40° C. to about 20° C. when starting up an air conditioner after an automobile has been parked in the open air in summertime, hence large fluctuations in heat load. Accordingly, a proper amount of refrigerant sealed off in the cycle is also greatly changed dependent on running conditions. In order to adjust that proper sealed-off amount, a receiver is installed on the outlet side of the condenser.

As the cooling load of the refrigerating cycle is reduced with the atmospheric temperature lowering, the condensing capacity of a heat exchanger is relatively enhanced by the combined effect of a reduction in the flow rate of refrigerant recirculating through the cycle system and a reduction in the atmospheric temperature for cooling the heat exchanger. As a result, especially under a condition of the low atmospheric temperature, the amount of refrigerant accumulating in the heat exchanger mounted as a condenser outside the compartment is increased, while the amount of refrigerant residing in the receiver, installed on the outlet side of the heat exchanger for adjusting refrigerant containment into the cycle, is decreased. This causes air bubbles to flow into an expansion valve, whereupon the cycle system causes a hunting and the refrigerating cycle fails to run normally. Overcoming that problem requires to enlarge the volume of the receiver and increase an amount of refrigerant sealed off. However, the cycle using R12 suffers from the problem of increasing an amount of refrigerant used which is under CFC regulations for the protection of earth environments. Also, use of an alternative coolant R134a or the like raises the problem of increasing an amount of expensive refrigerant used. Furthermore, in a refrigerating cycle system which includes a compressor of variable displacement type utilizing the pressure of delivery gas as a drive force for a capacity control mechanism, as described by way of example in SAE, Technical Paper Series 850040, 1985, the discharge gas pressure of the compressor is not raised as the condensing capacity of the heat exchanger is relatively enhanced under a condition of the low atmospheric temperature. This suffers from the problem that the capacity control can no longer work and an evaporator is frozen due to the excessive discharge flow rate.

SUMMARY OF THE INVENTION

A first object of the present invention is to provide an air conditioning apparatus for automobiles equipped with a heat exchanger and a control method for the apparatus, by which the heat transfer area of the heat exchanger can be properly controlled to permit a stable cycle operation, even when the capacity of a condenser is relatively overly enhanced under a condition of the low atmospheric temperature.

A second object of the present invention is to provide an air conditioning apparatus for automobiles which can control the capacity of a compressor of variable displacement type even under a condition of the low atmospheric temperature and, therefore, can operate without freezing an evaporator.

A third object of the present invention is to provide an air conditioning apparatus for automobiles which can reduce an amount of refrigerant sealed off into a cycle for saving of the refrigerant.

To achieve the first object, the present invention is first featured in that either one or both of headers of a heat exchanger is provided with at least one refrigerant flow rate control valve capable of opening and closing a refrigerant passage in each header, the heat exchanger has a refrigerant inlet provided in one header and a refrigerant outlet provided in the other header, and the control valve is opened and closed to change the number of the passages allowing the refrigerant to pass therethrough, for thereby changing the effective heat transfer area for heat exchange dependent on the atmospheric temperature.

Secondly, in order to change the effective heat transfer area of the heat exchanger in a substantially continuous manner, either one or both of the headers are shaped into the form of cylinders, and a piston is movably installed in each cylinder.

To achieve the above second object, the present invention is featured in that the refrigerant flow rate control valve is of an electric-powered valve capable of being opened and closed in response to an electric signal from the exterior, and the electric-powered valve is opened and closed in response to a signal produced by detecting the pressure or temperature of refrigerant within the heat exchanger, or a signal given by a value resulted from detecting the pressure and temperature of refrigerant at an outlet of the heat exchanger and making an arithmetic operation, for thereby enabling the compressor to be controlled since the condensing pressure is increased.

Alternatively, for simplification of the flow rate valve control system, the temperature (thermal energy) or pressure of refrigerant within the heat exchanger is directly used as a drive force for opening and closing the refrigerant flow rate control valve.

To achieve the above third object, heat transfer pipes respectively forming the refrigerant passages are disposed to extend substantially in the direction of gravity so that the condensed liquid refrigerant is accumulated in both the lower header and the lower portions of the heat transfer pipes.

The present invention can be summarized as follows. First of all, in a heat exchanger comprising a pair of headers disposed parallel to each other, a plurality of heat transfer pipes each having opposite ends inserted to the headers, respectively, and arranged to form refrigerant passages side by side between both the headers, and a number of fins disposed in respective air passage spaces between adjacent twos of the heat transfer pipes in contact relation with the associated heat transfer pipes, either one or both of the headers is provided with at least one refrigerant flow rate control valve capable of opening and closing a refrigerant passage in the corresponding header. Then, a refrigerant inlet is provided in one header and a refrigerant outlet is provided in the other header. By opening and closing one or more control valves in a combined manner, therefore, a pattern of refrigerant passages can be modified to change the effective heat transfer area of the heat exchanger for controlling the capacity thereof. Consequently, the liquid refrigerant will not be excessively accumulated in the condenser to prevent a two-phase flow of gas and liquid from flowing into an expansion valve, whereby the stable cycle operation can be achieved.

Secondly, by constituting the refrigerant flow rate control valve as an electric-powered valve, and by detecting a refrigerant temperature and/or pressure in the heat exchanger or a refrigerant state at the outlet of the heat exchanger, and then controlling the electric-powered valve based on a control signal obtained from the detected value(s), the condensing capacity of the heat exchanger can be reduced under a condition of the low atmospheric temperature. It is therefore possible to prevent a hunting of the expansion valve without increasing an amount of refrigerant sealed off in the heat exchanger, and allow a compressor with a function of capacity control to produce a delivery gas pressure therefrom enough to drive its capacity control mechanism.

Thirdly, the heat transfer pipes respectively forming the refrigerant passages are arranged to extend substantially in the direction of gravity, so that the condensed liquid refrigerant is accumulated in both the lower header and the lower portions of the heat transfer pipes. This permits to improve a valve closing or pipe isolating capability with the resultant liquid-sealing condition, and also to provide a function of receiver. Accordingly, the need of installing a separate receiver can be eliminated to reduce the amount of refrigerant sealed off in the cycle.

DETAILED DESCRIPTION OF THE PREFERRED EMBODIMENTS

Hereinafter, preferred embodiments of the present invention will be described with reference to FIGS. 1 through 24 by taking an air conditioning apparatus for automobile as an example.

Figure 1:
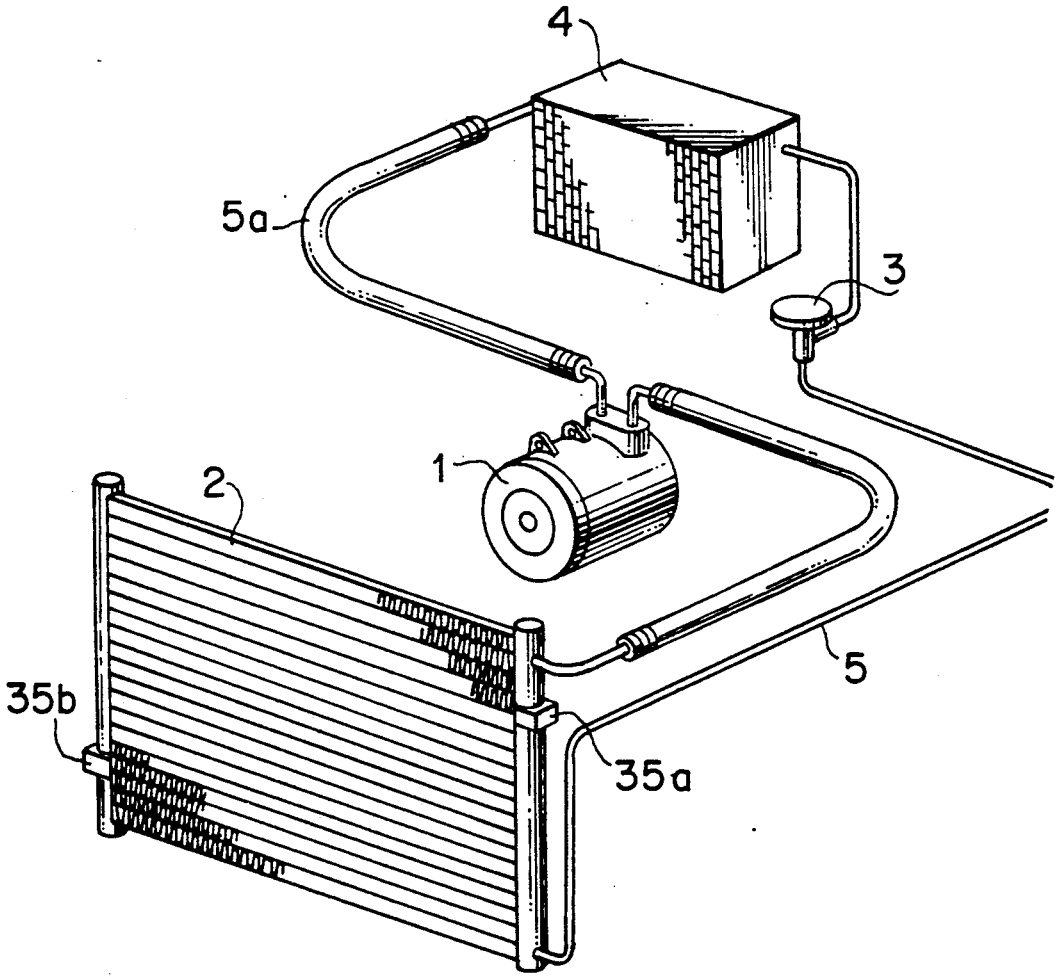
FIG. 1 is a perspective view showing a cycle arrangement of a first embodiment of the present invention.

To begin with, a first embodiment of the present invention will be explained by referring to FIGS. 1 through 4. FIG. 1 is a perspective view showing an arrangement of a refrigerating cycle system of an air conditioning apparatus for automobiles. The refrigerating cycle system of the air conditioning apparatus for automobiles comprises a compressor 1 of variable displacement type, for example, a condenser 2, an expansion valve 3, a evaporator 4, and pipes 5 connecting between these components. The compressor 1 is driven by an engine (not shown) of the automobile via a magnetic clutch (not shown). The condenser 2 is disposed in front of a radiator (not shown) adapted to air-cool cooling water for the engine, and is cooled with the incoming air while the automobile is traveling. The evaporator 4 is disposed in a duct for introducing the conditioned air into a compartment of the automobile for the purpose of air-condition in cooperation with a heater (not shown). The conditioned air is fed into the compartment by means of a fan.

Figure 2:
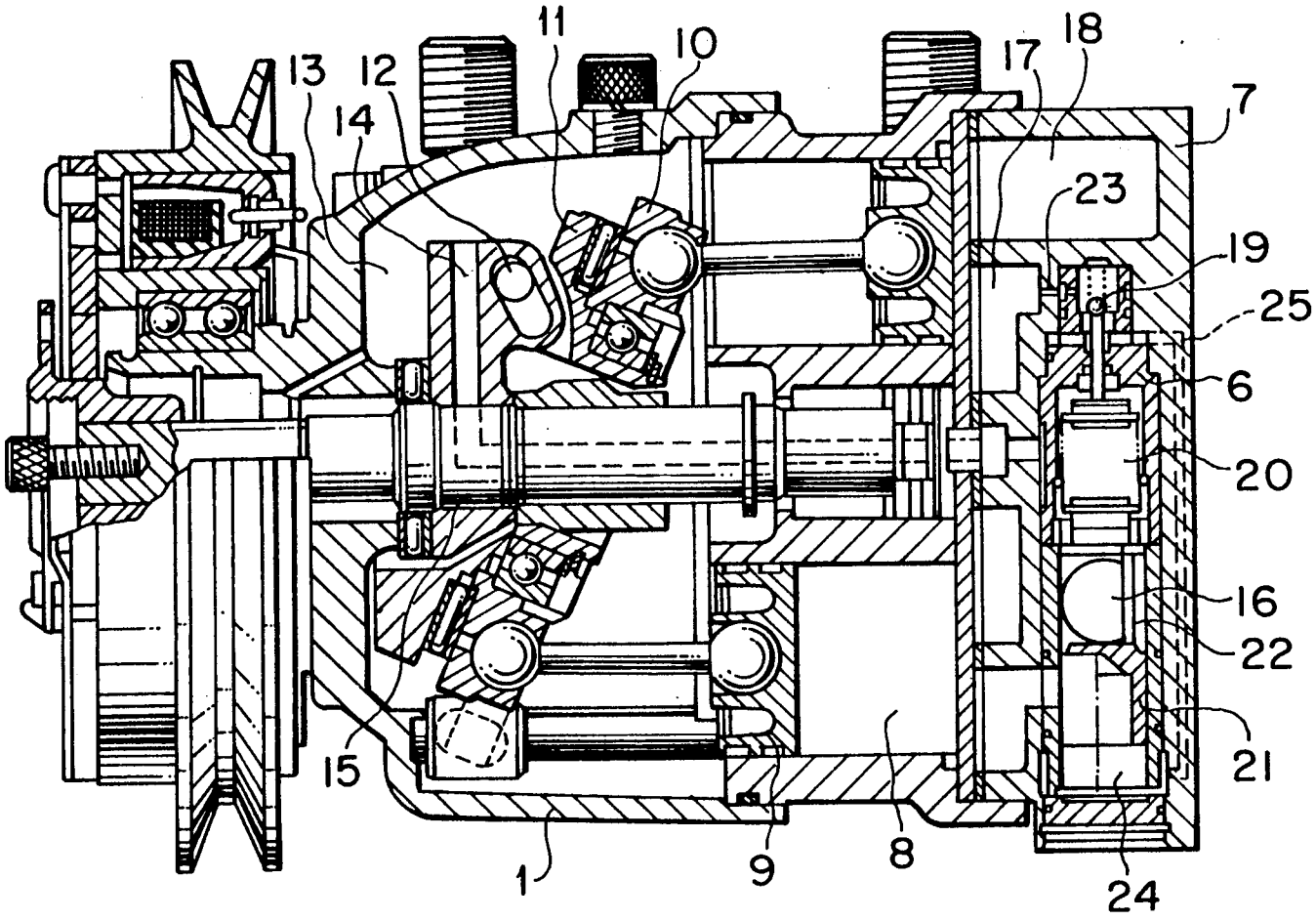
FIG. 2 is a longitudinal sectional view of a compressor of variable displacement type.

When the compressor 1 is started up by a control circuit for controlling the air conditioning apparatus, a refrigerant is compressed by the compressor 1 into a high pressure, and is cooled by the condenser 2 for conversion into a liquid refrigerant of high pressure and low temperature. The liquid refrigerant is adiabatically expanded by the expansion valve 3 into a low-pressure, low-temperature state. Afterward, the refrigerant is evaporated in the evaporator 4 and returned to the compressor 1. When the refrigerant is evaporated in the evaporator 4, the surrounding air is cooled. The compressor 1 of variable displacement type is one that drives a capacity control valve 6 with the discharge gas pressure of the compressor, as shown in FIG. 2 by way of example. The compressor 1 mainly comprises the capacity control valve 6 disposed in a rear cover, a piston 9 capable of reciprocating in each cylinder cavity 8, a piston support 10 for varying the stroke volume of each piston 9, a journal 11, a pivot 12, a pressure equalizing pipe 14 for keeping the pressure in a crank chamber 13 equal to the pressure at an inlet 16 of the compressor, a shaft 15 for driving the journal 11 to rotate, a delivery chamber 17, and a suction chamber 18. The capacity control valve 6 comprises a pilot valve 19, a bellows 20, a main valve 21, and a spring 22 normally biasing the main valve 21 in the valve-opening direction. Furthermore, the rear cover 7 is provided with a communication hole 23 connected to a delivery port section for introducing the delivery gas pressure of the compressor, and a pressure leading hole 25 for introducing the discharge gas reduced in pressure to an accumulator chamber 24 formed on the rear side of the main valve 21. The pressure in a crank chamber 13 of the compressor 1 is always kept equal to the gas pressure at the compressor inlet 16 with the aid of the pressure equalizing pipe 14. Operation of such a capacity control mechanism will now be described by way of example. When a revolution speed of the engine for driving the compressor 1 is raised, or when the thermal load acting on the evaporator 4 is reduced, the pressure at the compressor inlet 16 is lowered. This also lowers the pressure surrounding the bellows 20 that is to be always kept equal to the pressure at the compressors inlet 16. The bellows 20 is thereby extended to push up the pilot valve 19. Therefore, the compressor discharge gas pressure in the delivery chamber 17 passes through the pilot valve 19 and then the pressure leading hole 25, following which the reduced pressure is introduced to the accumulator chamber 24 formed on the rear side of the main valve 21, so that the back pressure of the main valve 21 is raised to overcome a resilient force of the spring 22 for reducing an opening degree of the main valve. Accordingly, the pressure drop is so increased as to make the pressure in the suction chamber 18 and the cylinder cavity 8 lower than the pressure at the compressor inlet 1. Because the pressure in the crank chamber 13 is kept equal to the pressure at the compressor inlet 16 with the aid of the pressure equalizing pipe 14, the pressure in the crank chamber 13 acting on the back surface of the piston 9 becomes higher than the pressure in the cylinder cavity 8 acting on a head of the piston 9. The journal 11 is therefore subjected to the counterclockwise moment about a pivot 12, and a piston support 10 rotatably attached to the journal 11 is rotated counterclockwise about the pivot 12. As a result, a stroke of the piston 9 can be decreased to reduce the capacity of the compressor 1.

Next, an arrangement of the condenser (heat exchanger) 2 will be described with reference to FIG. 3. The condenser 2 comprises a pair of inlet header **30*a* and an outlet header 30*b* disposed parallel to each other, a plurality of heat transfer pipes 31 having their opposite ends inserted into the respective headers and arranged to form refrigerant passages side by side between both the headers, and a number of fins 32 disposed between every adjacent twos of the heat transfer pipes 31. The inlet header 30*a* and the outlet header 30*b* have a refrigerant inlet 33 and a refrigerant outlet 34, respectively. First and second partitions 36*a*, 36*b* are provided in the inlet and outlet headers 30*a*, 30*b*, respectively, to divide or group the refrigerant passages in the headers. The first and second partitions 36*a*, 36*b* are provided with first and second refrigerant flow rate control valves 35*a*, 35*b*, respectively, in such a manner as to selectively open and close the groups of refrigerant passages separated from each other for defining a continuous path from the inlet to the outlet. When the first and second refrigerant flow rate control valves 35*a*, 35*b* are both closed, the gas refrigerant incoming through the refrigerant inlet 33 first passes leftwardly (on the drawing) through the heat transfer pipes 31 in a section A while being cooled, and flows into the outlet header 30*b*. Then, the refrigerant is reversed in the direction to rightwardly pass through the heat transfer pipes 31 in a section B while being condensed and liquefied, and flows into the inlet header 30*a*. The refrigerant is reversed again in the direction to leftwardly pass through the heat transfer pipes 31 in a section C while being condensed and liquefied, and flows out through the refrigerant outlet 34. While the numbers of heat transfer pipes in the sections A, B and C may be set substantially equal to each other, it is generally advantageous for the purpose of reducing pressure loss in the heat transfer pipes 31** that the number of heat transfer pipes in the section A where the gas refrigerant exists in a large proportion is set to be largest, and the numbers of heat transfer pipes in the sections B, C where an amount of the condensed liquid refrigerant increases and a refrigerant flow speed decreases are set to be gradually reduced in this order.

Figure 3:
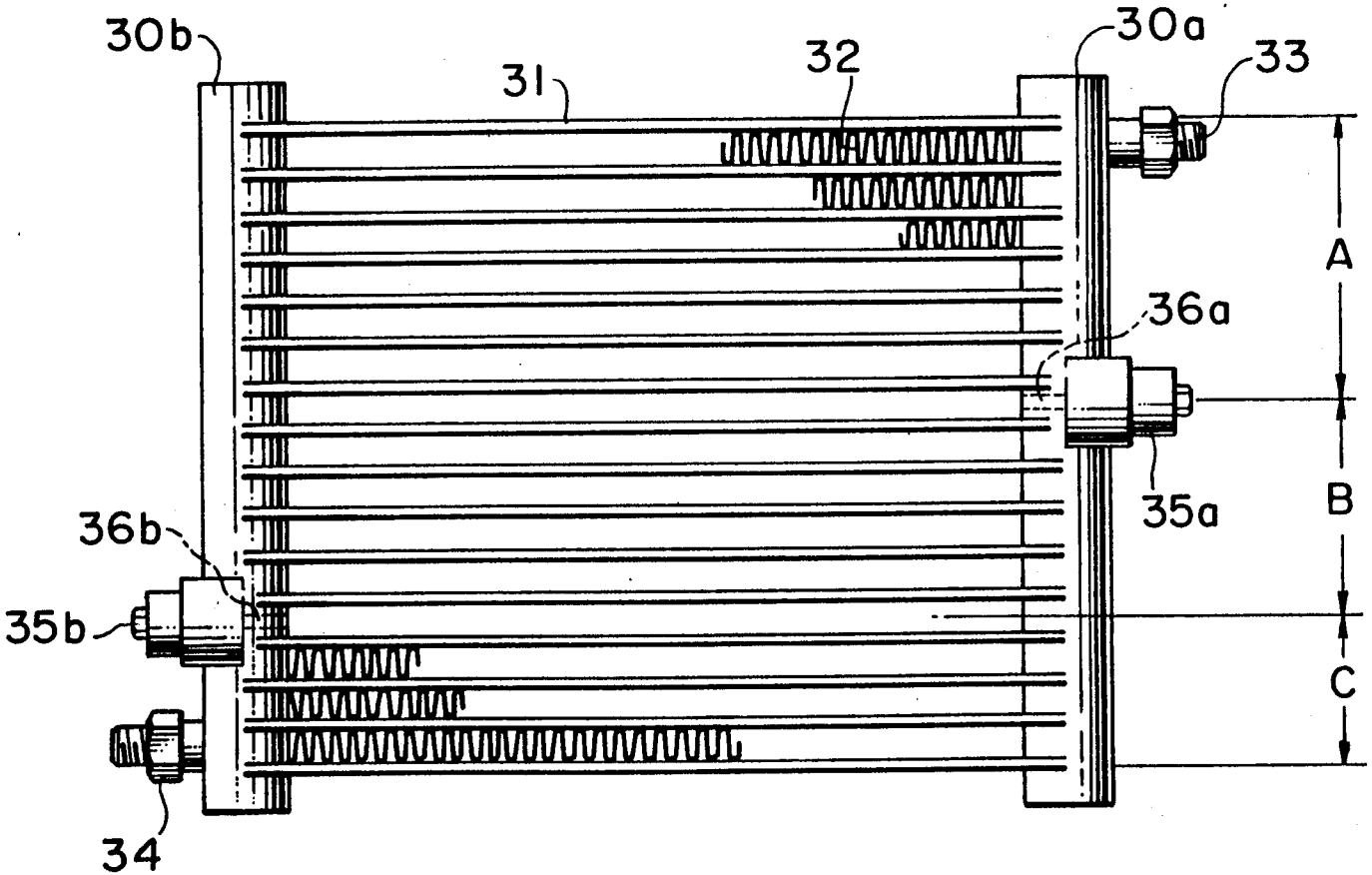
FIG. 3 is a front view showing an arrangement of a condenser in the first embodiment.
Figure 4:
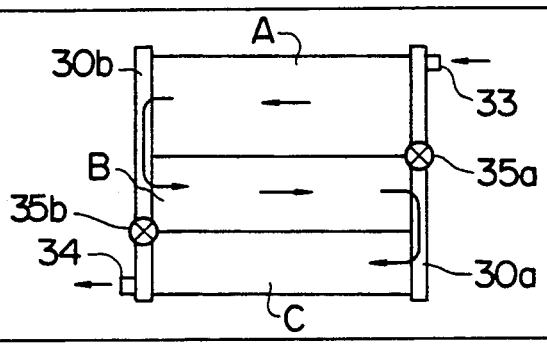
FIG. 4 is a set of diagrams showing changes in the heat conducting area and flows of a refrigerant in the condenser shown in FIG. 3.
Figure 4:
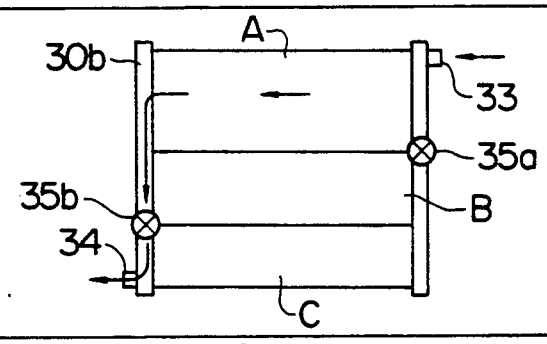
Figure 4:
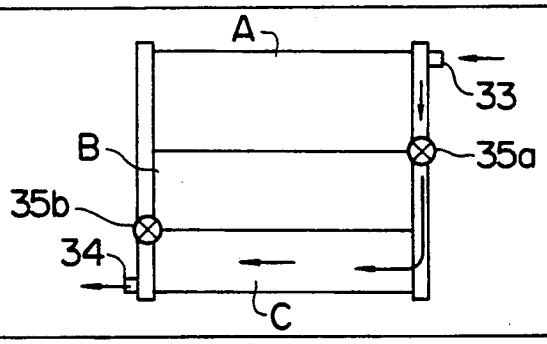
Figure 4:
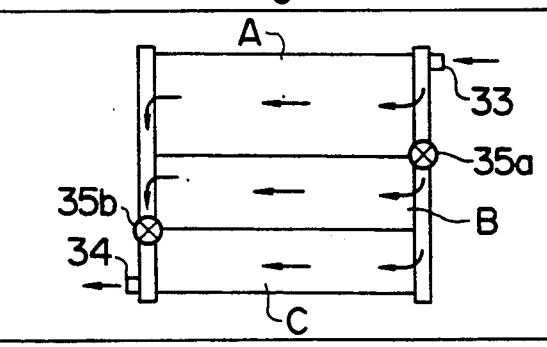

FIG. 4 shows the relationship of opened and closed states of the refrigerant flow rate control valves **35*a*, 35*b* of the condenser shown in FIG. 3 with respect to flow patterns of the refrigerant through the heat transfer pipes 31. A case (I) corresponds to the state that the first and second refrigerant flow rate control valves 35*a*, 35*b* are both closed, i.e., that the refrigerant incoming from the refrigerant inlet 33 passes through the sections A, B, C and flows out through the refrigerant outlet 34. In this case, all of the heat transfer pipes 31 are used for heat exchange to maximize the effective heat transfer area. A case (II) corresponds to the state that the first refrigerant flow rate control valve 35*a* is closed and the second refrigerant flow rate control valve 35*b* is opened, i.e., that the refrigerant incoming from the refrigerant inlet 33 passes through the section A and then the outlet header 30*b*, followed by flowing out through the refrigerant outlet 34. In this case, only the section A is used for heat exchange to reduce the effective heat transfer area. A case (III) corresponds to the state that the first refrigerant flow rate control valve 35*a* is opened and the second refrigerant flow rate control valve 35*b* is closed, i.e., that the refrigerant incoming from the refrigerant inlet 33 passes through the section C and flows out through the refrigerant outlet 34. In this case, only the section C is used for heat exchange to further reduce the effective heat transfer area. A case (IV) corresponds to the state that the first and second refrigerant flow rate control valves 35***a*, 35*b* are both opened. The sections A, B, C are all used for heat exchange as with the case (I). However, this case has an advantage of reducing the pressure loss in comparison with the case (I), because the once-through area of the refrigerant passages constituted by the heat transfer pipes 31 is increased and the refrigerant flow speed is lowered.

As described above, by selectively opening and closing the first and second refrigerant flow rate control valves 35*a*, 35*b*, the heat transfer area of the heat exchanger can be changed. Therefore, even when the condensing capacity of the heat exchanger is relatively enhanced with the combined effect of a reduction in the cooling load of the refrigerating cycle upon a descent of the atmospheric temperature and a reduction in the flow rate of refrigerant recirculating through the cycle system, the amount of refrigerant accumulating in the heat exchanger will not be increased by reducing the heat transfer area of the heat exchanger. This prevents air bubbles from flowing into the expansion valve, so that the cycle system will not cause a hunting and the refrigerating cycle can continue to normally run.

Figure 5:
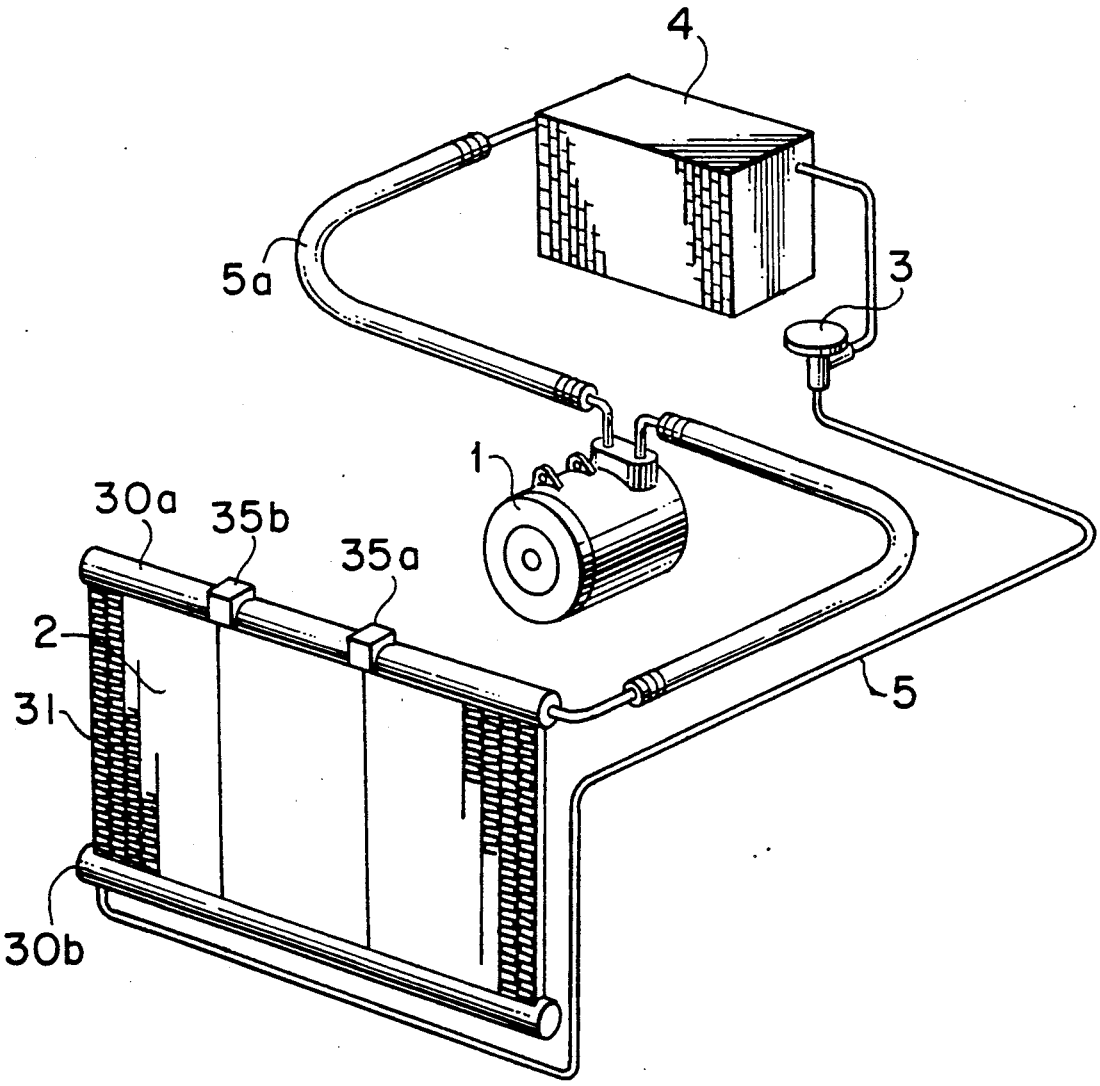
FIG. 5 is a perspective view showing a cycle arrangement of a second embodiment.

A second embodiment will be described below with reference to FIGS. 5 through 7. FIG. 5 shows an arrangement of a refrigerating cycle system similar to that shown in FIG. 1. In this embodiment inlet and outlet headers 30*a*, 30*b* of a condenser 2 are provided in the upper and lower portions of heat transfer pipes 31, respectively.

Figure 6:
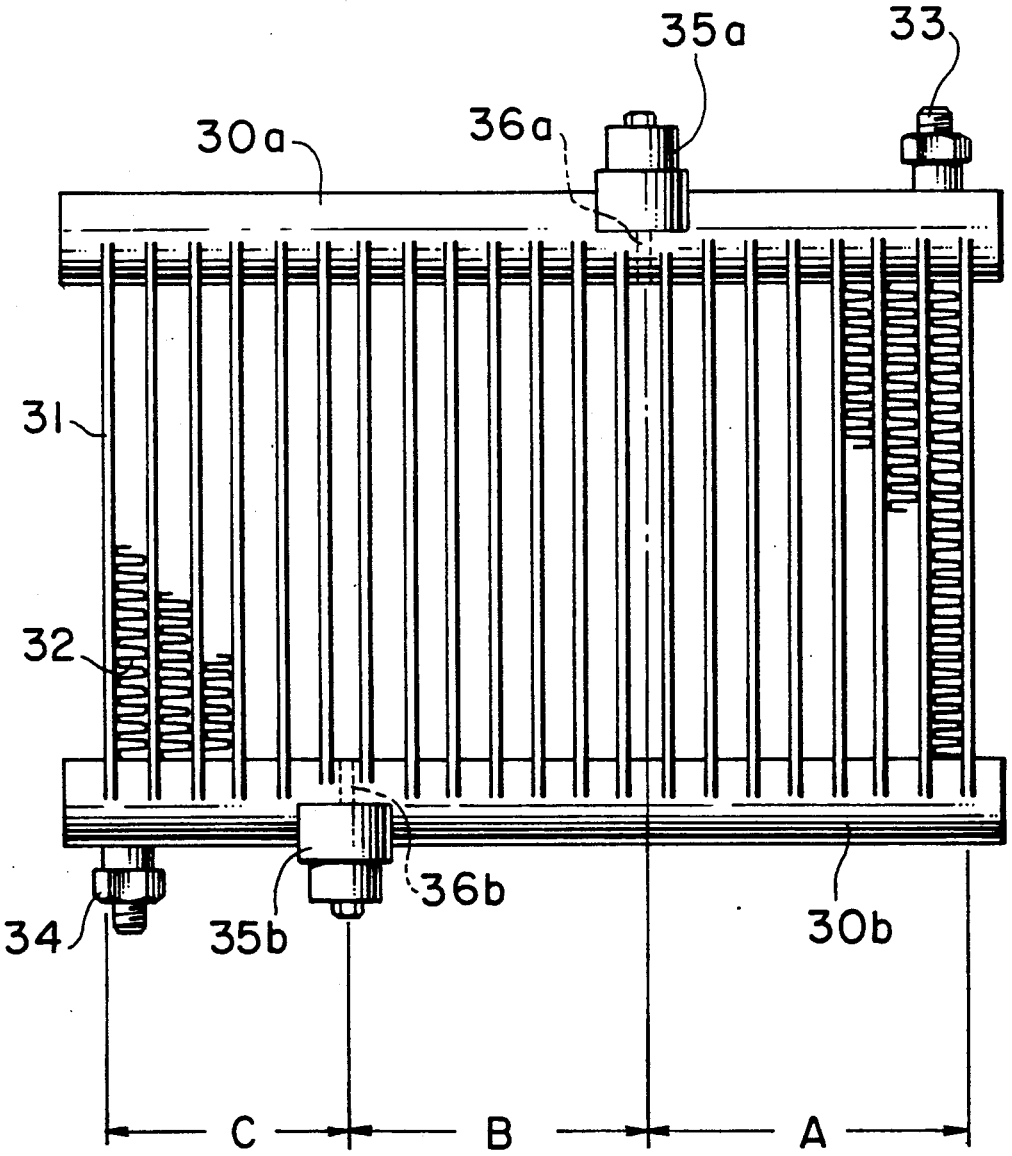
FIG. 6 is a front view showing an arrangement of a condenser in the second embodiment.

FIG. 6 shows an arrangement of the condenser 2 of the second embodiment.

As pointed out above, this second embodiment is different from the foregoing first embodiment shown in FIG. 3 in that a group of the heat transfer pipes 31 are installed to extend substantially in the direction of gravity. With the heat transfer pipes 31 thus arranged, when the refrigerant gas incoming from the refrigerant inlet 33 in a state of overheated gas is distributed and flown into the respective heat transfer pipes 31 in the inlet header 30*a* to be cooled and condensed for liquefaction, the refrigerant is accelerated to flow down under the action of gravity for improving the heat transfer efficiency. Also, the liquid refrigerant is accumulated in the lower header 30*b* and the lower portions of the heat transfer pipes 31, both of which can therefore also serve to function as a receiver as explained later.

Similarly to the first embodiment, the first header 30*a* is provided with a first partition 36*a* and a first refrigerant flow rate control valve 35*a*, and the second header 30*b* is provided with a second partition 36*b* and a second refrigerant flow rate control valve 36*b* in this embodiment. By selectively closing the first and second refrigerant flow rate control valves 35*a*, 35*b*, the entire group of the heat transfer pipes 31 can be separated into three heat exchange sections A, B and C. While the numbers of heat transfer pipes in the sections A, B and C may be set substantially equal to each other, it is generally advantageous for the purpose of reducing pressure loss that the numbers of heat transfer pipes are gradually reduced in the order of the sections A, B and C where the proportion of the gas refrigerant is increased in the same order.

Figure 7:
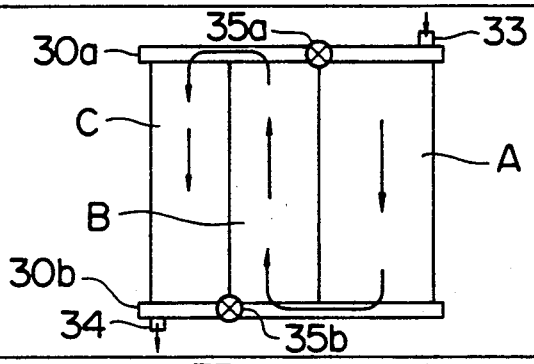
FIG. 7 is a set of diagrams showing changes in the heat transfer area and flows of a refrigerant in the condenser shown in FIG. 6.
Figure 7:
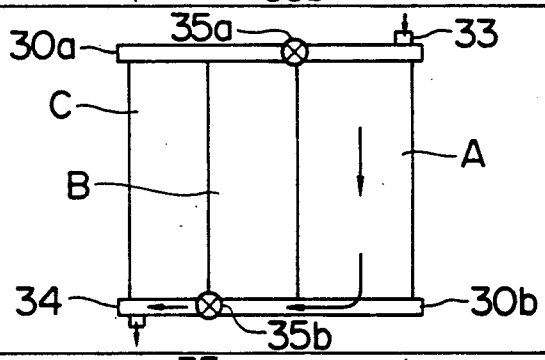
Figure 7:
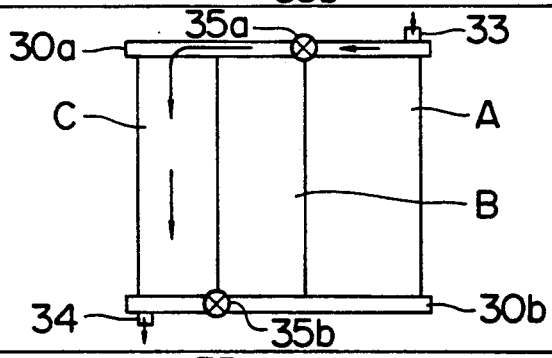
Figure 7:
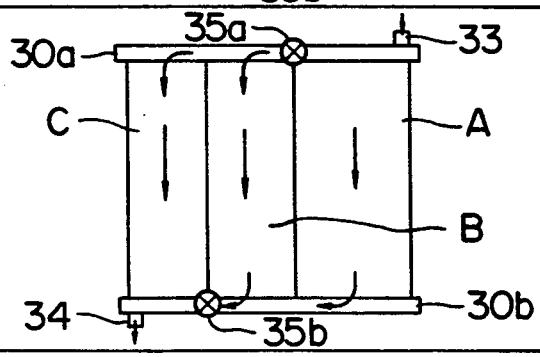

FIG. 7 shows the relationship of opened and closed states of the refrigerant flow rate control valves 35*a*, 35*b* with respect to flow patterns of the refrigerant through the heat transfer pipes 31. A case (I) corresponds to the state that the first and second refrigerant flow rate control valves 35*a*, 35*b* are both closed, i.e., that the refrigerant incoming from the refrigerant inlet 33 passes through the sections A, B, C and flows out through the refrigerant outlet 34. In this case, all of the heat transfer pipes 31 are used for heat exchange to maximize the effective heat transfer area. It is to be noted that a part of the outlet header 30*b* locating between the second refrigerant flow rate control valve 35*b* and the refrigerant outlet 34, and the lower portions of the group of the heat transfer pipes 31 serve as a receiver. A case (II) corresponds to the state that the first refrigerant flow rate control valve 35*a* is closed and the second refrigerant flow rate control valve 35*b* is opened, i.e., that the refrigerant incoming from the refrigerant inlet 33 passes through only the section A and then the outlet header 30*b*, followed by flowing out through the refrigerant outlet 34. The effective heat transfer area is thereby reduced. In this case, the presence of the liquid refrigerant filling in and flowing through the outlet header 30*b* brings the lower ends of the heat transfer pipes in the sections B and C into a liquid-sealed state, whereby the refrigerant is prevented from flowing into the heat transfer pipes to reduce the heat transfer area with more certainty. This feature is different from the case (II) shown in FIG. 3. A case (III) corresponds to the state that the first refrigerant flow rate control valve 35*a* is opened and the second refrigerant flow rate control valve 35*b* is closed, i.e., that only the section C is used for heat exchange. Accordingly, by setting the number of heat transfer pipes in the section C, the effective heat transfer area is further reduced. A case (IV) corresponds to the state that the first and second refrigerant flow rate control valves 35*a*, 35*b* are both opened. While the sections A, B, C are all used for heat exchange as with the case (I), the refrigerant also flows in the direction of gravity in the section B. Unlike the section B in the case (I), therefore, the partially liquefied refrigerant will never flow reversely against the gravity, making it possible to further improve the heat transfer efficiency and provide the capacity of the heater exchanger greater than that in the case (I). In addition, the outlet header 30*b* and the lower portions of the heat transfer pipes 31 in the sections A, B, C double as a receiver to provide the receiver capacity greater than that in the case (I).

With the above arrangement, the liquid refrigerant is accumulated in the outlet header 30*b* and the lower portions of the heat transfer pipes 31 arranged substantially in the direction of gravity, both of which therefore also function as the receiver. When the atmospheric temperature is low, the region where the liquid refrigerant fills the lower portions of the heat transfer pipes 31 is increased and the capacity of the condenser is determined by that region. A reduction in the two-phase region also leads to an advantage of automatically lowering the condensing region. Even when the condensing capacity of the condenser as the heat exchanger is relatively enhanced, the heat transfer area of the heat exchanger can be reduced so that air bubbles are prevented from flowing into the expansion valve to run the refrigerating cycle in a stable manner. Since the liquid refrigerant will not flow reversely due to the action of gravity, the heat transfer efficiency can be improved.

Moreover, the lower portions of the heat transfer pipes and the outlet header can be utilized as the receiver, thereby eliminating the need of providing a separate receiver which was essential in the prior art.

Figure 8:
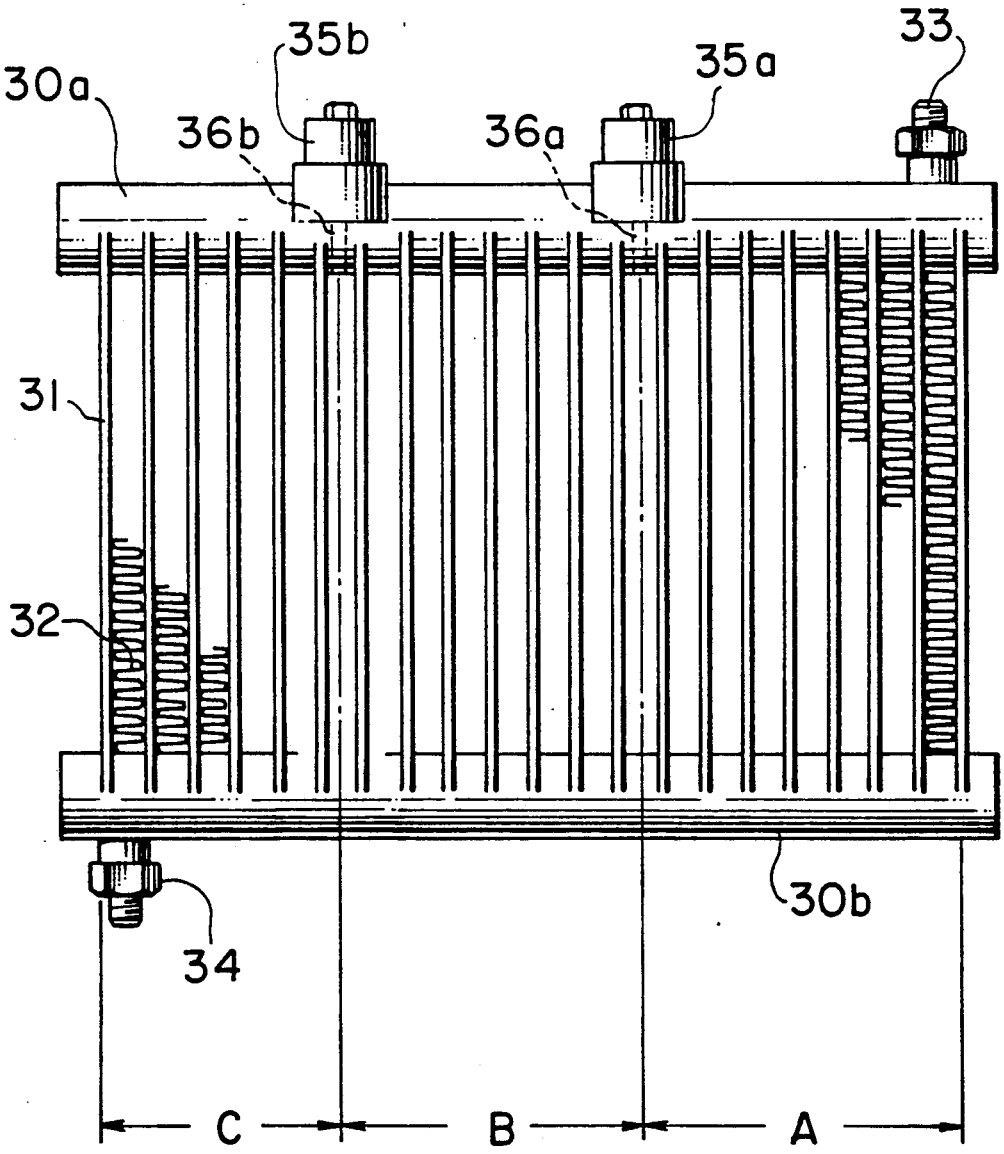
FIG. 8 is a front view showing an arrangement of a condenser of a third embodiment.
Figure 9:
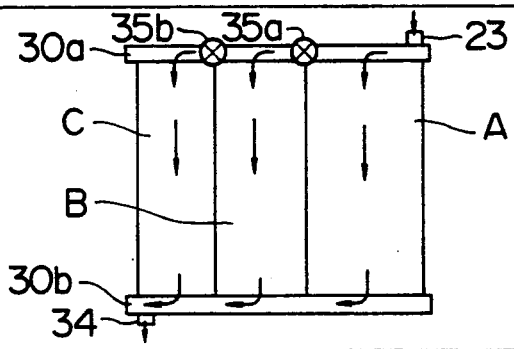
FIG. 9 is a set of diagrams showing changes in the heat transfer area and flows of a refrigerant in the condenser shown in FIG. 8.
Figure 9:
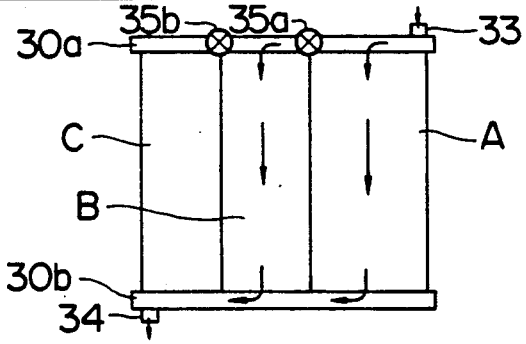
Figure 9:
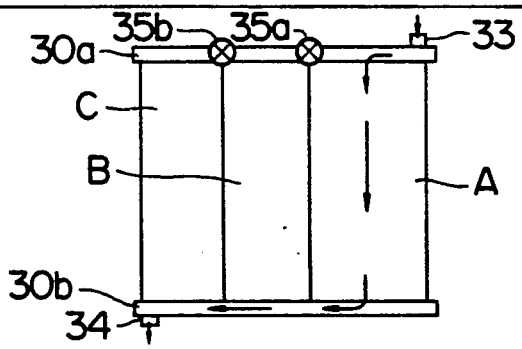

FIGS. 8 and 9 show a third embodiment of the present invention. This embodiment is similar to the second embodiment shown in FIG. 6, but is different from the second embodiment in that the first partition 36*a*, the first refrigerant flow rate control valve 35*a*, the second partition 36*b*, and the second refrigerant flow rate control valve 35*b* are all provided in the inlet header 30*a*. With such an arrangement, although a group of the heat transfer pipes 31 is divided into three sections A, B and C similarly to the first and second embodiments, the refrigerant flows through the heat transfer pipes 31 substantially in the direction of gravity in all the cases regardless of the opened and closed states of the first and second refrigerant flow rate control valves 35*a*, 35*b*, whereby the capacity of the heat exchanger can be improved. Also, regardless of the opened and closed states of the first and second refrigerant flow rate control valves 35*a*, 35*b*, the outlet header 30*b* and the lower portions of all the heat transfer pipes 31 double as a receiver. As a result, unlike the first and second embodiments, the receiver volume will not be changed depending on the opened and closed states of the refrigerant flow rate control valves 35*a*, 35*b*, and the stable operation is enabled at the maximum capacity.

FIG. 9 shows the relationship of opened and closed states of the refrigerant flow rate control valves 35*a*, 35*b* with respect to flow patterns of the refrigerant through the heat transfer pipes 31. A case (I) corresponds to the state that the first and second refrigerant flow rate control valves 35*a*, 35*b* are both opened, i.e., that the super-heated gas refrigerant incoming from the refrigerant inlet 33 is distributed in the inlet header 30*a* to the respective heat transfer pipes and flows downwardly through the sections A, B, C while being cooled and condensed for liquefaction, followed by flowing out through the refrigerant outlet 34. In this case, all of the sections A, B, C are used for heat exchange to maximize the effective heat transfer area. Further, the outlet header 30*b* and the lower portions of the heat transfer pipes 31 serve as a receiver so that the stable operation is enabled over a wide range of atmospheric temperatures. A case (II) corresponds to the state that the first refrigerant flow rate control valve 35*a* is opened and the second refrigerant flow rate control valve 35*b* is closed. In this case, only the sections A and B are used for heat exchange and, therefore, the effective heat transfer area becomes smaller than the case (I). Also, since the outlet header 30*b* and the lower portions of the heat transfer pipes 31 are filled with the liquid refrigerant, the lower ends of the heat transfer pipes in the section C are brought into a liquid-sealed state, whereby the refrigerant can be prevented from upwardly flowing into those heat transfer pipes and the heat exchanging capability can be positively disabled in the section C. A case (III) corresponds to the state that the first refrigerant flow rate control valve 35*a* is closed. In this case, only the section A takes part in heat exchange and the effective heat transfer area is further reduced. As with the cases (I) and (II), the outlet header 30*b* and the lower portions of the heat transfer pipes 31 also function as a receiver. Furthermore, similarly to the case (II), the lower ends of the heat transfer pipes in the sections B and C are brought into a liquid-sealed state, whereby the refrigerant can be prevented from upwardly flowing into those heat transfer pipes. In this case (III), the second refrigerant flow rate control valve 35*b* may be either opened or closed. While the effective heat transfer area is drastically reduced from a maximum value in the first and second embodiments, the above arrangement of this embodiment has an advantage of permitting the effective heat transfer area to be stepwisely increased and decreased. It is needless to say that the partitions 36 and the refrigerant flow rate control valves 35 may be provided in the inlet header 30*a* in one pair, or three or more pairs.

Figure 10:
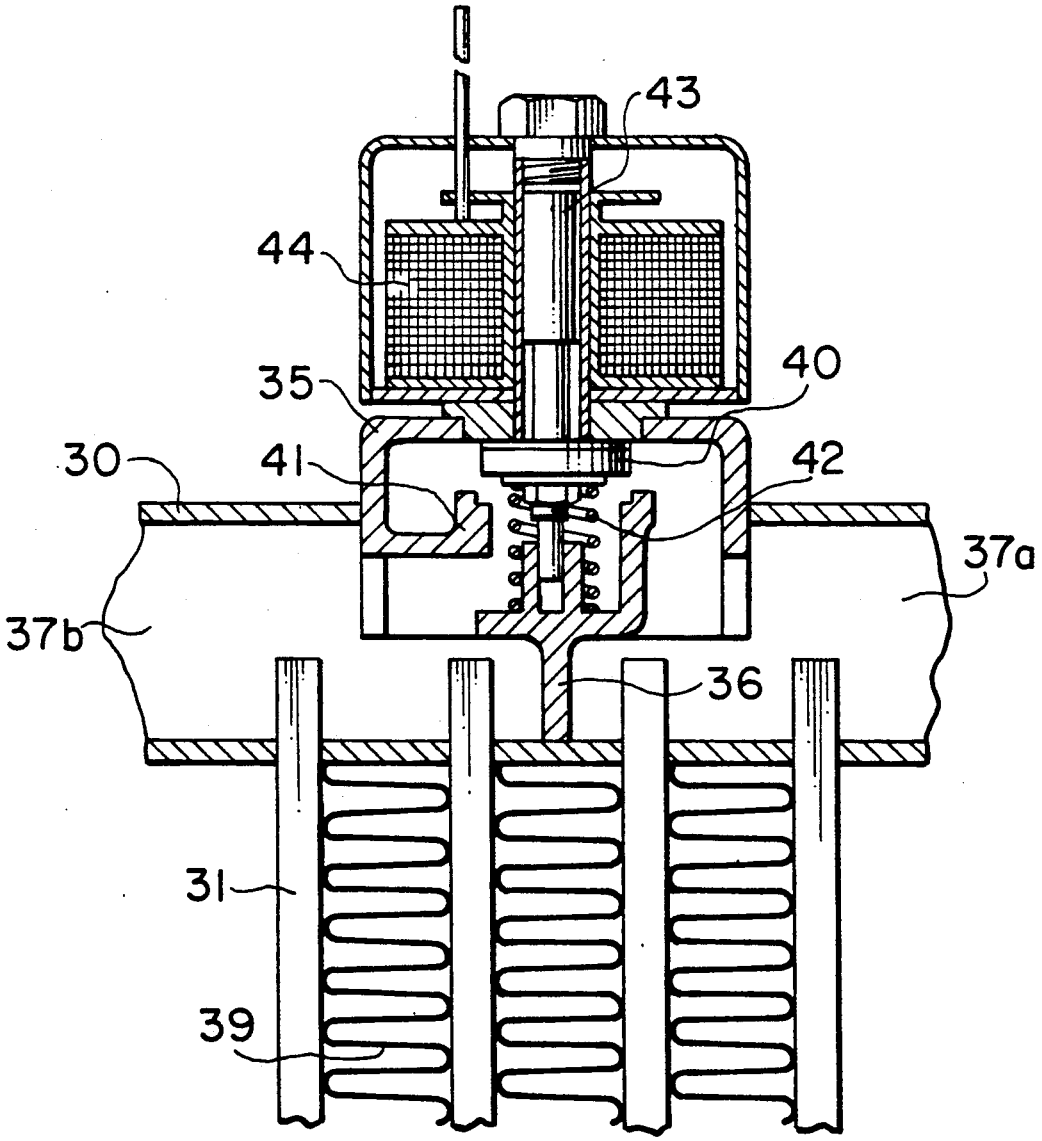
FIGS. 10 through 12 are longitudinal sectional views showing different structures of a refrigerant flow rate control valve.
Figure 11:
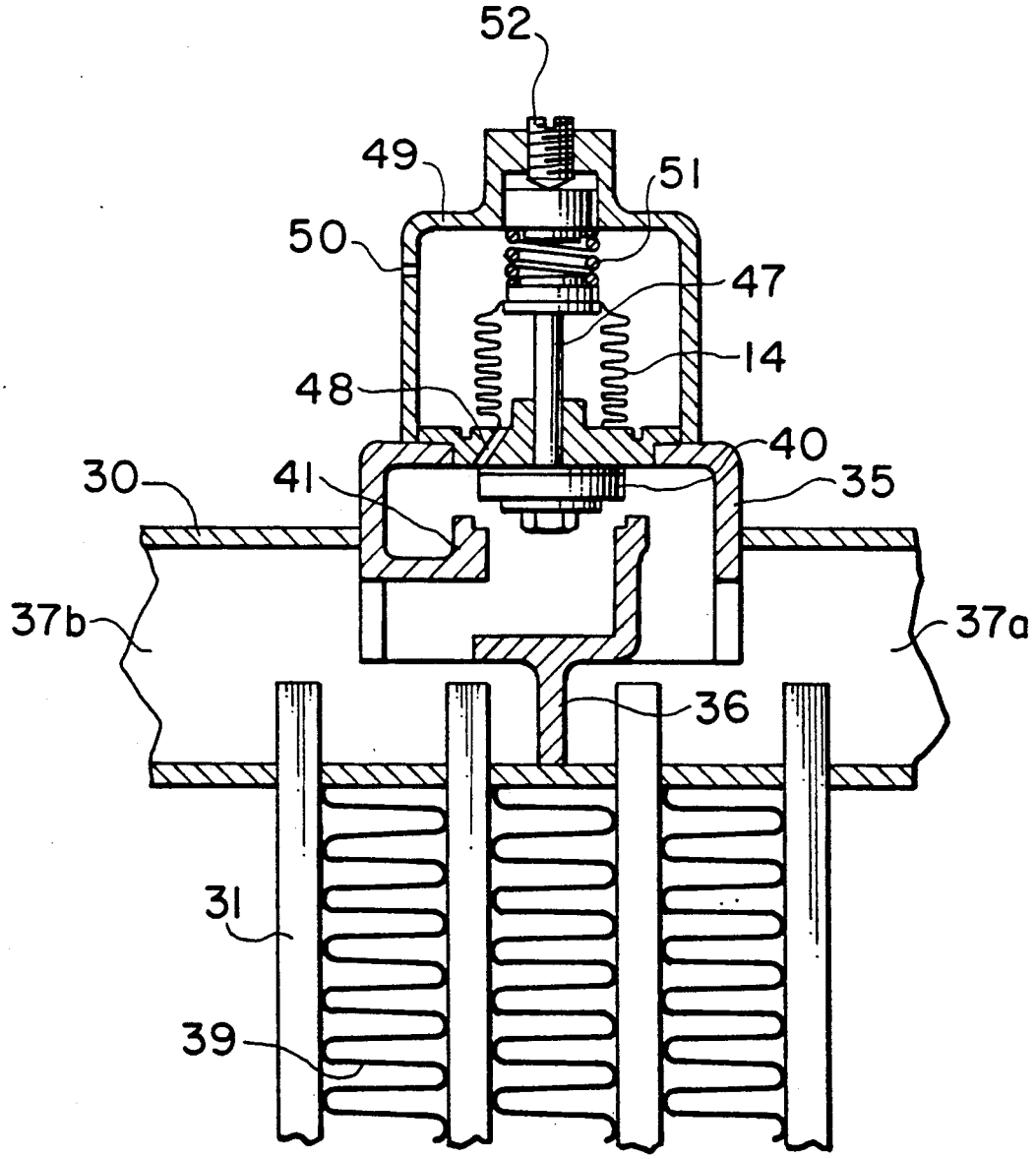
Figure 12:
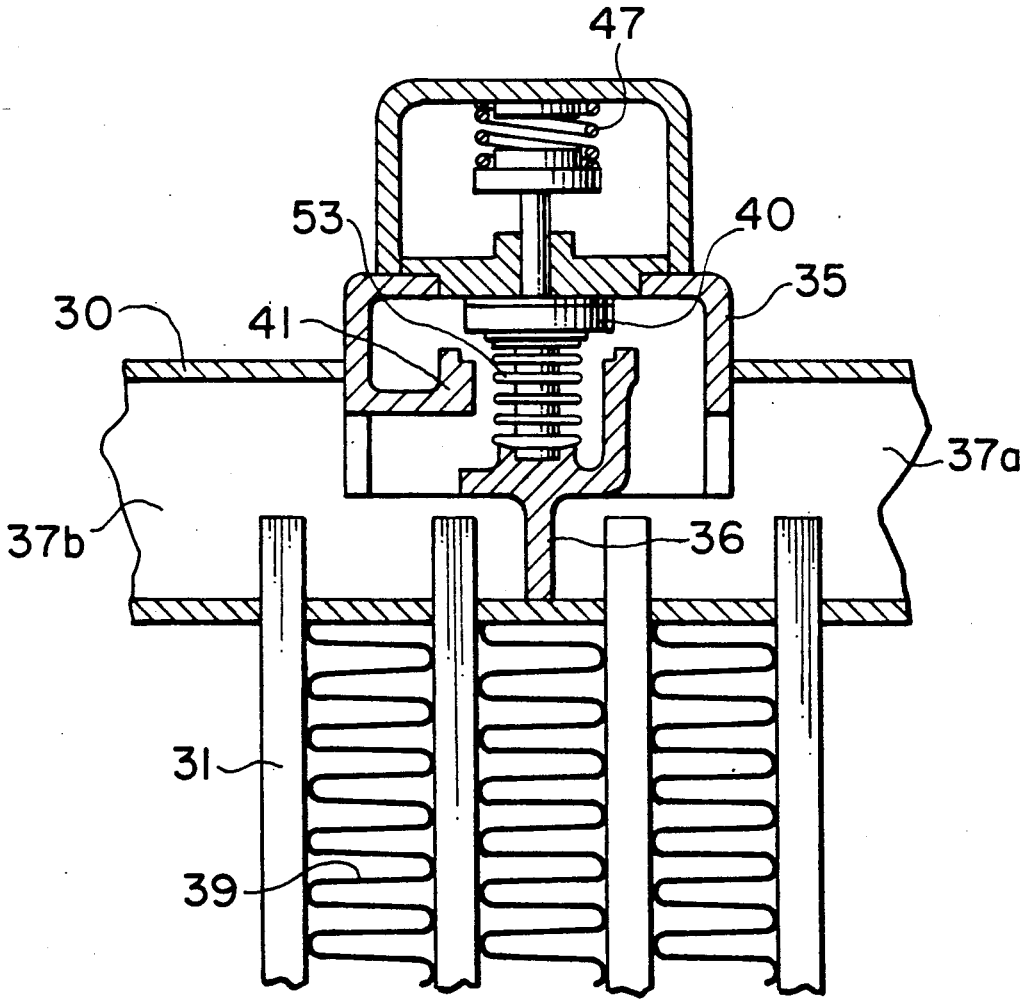

FIGS. 10 through 12 show different embodiments of the refrigerant flow rate control valve 35 which can be opened and closed in response to an electric signal from the exterior. The refrigerant flow rate control valve 35 shown in FIG. 10 has a partition 36 to separate a refrigerant passage 37 in a header 30. When a valve body 40 is seated onto a valve seat 41, a flow of the refrigerant is blocked off between a right-hand refrigerant passage 37*a* in the header 30 rightwardly of the partition 36 and a left-hand refrigerant passage 37*b* in the header 30 leftwardly of the partition 36. The valve body 40 is arranged to be actuated in cooperation with a plunger 43. When a solenoid 44 is not energized, the valve body 40 is pushed up with a resilient force of a spring 42 which normally biases the valve body 40 in pushing-up or valve-opening direction. Therefore, a refrigerant passage is established between the valve body 40 and the valve seat 41, allowing the refrigerant to flow between the right-hand refrigerant passage 37*a* and the left-hand refrigerant passage 37*b*.

Meanwhile, when closing the refrigerant flow rate control valve 35 in response to an electric signal from the exterior, an electric current is applied to the solenoid 44 to attract the plunger 43 so that the valve body 40 is pressed downwardly by overcoming the resilient force of the spring 42 and seated onto the valve seat 41. As a result, the flow of the refrigerant is blocked off between the right-hand refrigerant passage 37*a* and the left-hand refrigerant passage 37*b*.

FIG. 11 shows the refrigerant flow rate control valve 35 of type which is opened and closed dependent in the refrigerant pressure in the header 30. As with the embodiment of FIG. 10, the refrigerant flow rate control valve 35 of this embodiment has the partition 36 for separating the refrigerant passage 37 in the header 30, the valve body 40, and the valve seat 41. Unlike the above embodiment, however, the present valve body 40 is fixed to a rod 47 which is arranged to be actuated in cooperation with a bellows 46. Through a pressure leading hole 48, the refrigerant pressure in the header 30 is introduced to the inside of the bellows 46 to act in the direction of extending the bellows. Through a pressure equalizing hole 50 formed in a body 49, the atmospheric pressure acts on the surrounding of the bellows 46 in the direction of contracting the bellows, and a pressure setting spring 51 also exerts a resilient force acting in the direction of closing the valve body 40. When the heat load is large and the refrigerant pressure in the header 30 is high, the force pushing up the valve body 40 due to the pressure in the bellows overcomes the force acting in the valve-closing direction due to the pressure setting spring 51 and the atmospheric pressure. The valve body 40 is thereby pushed up to establish the refrigerant passage between the valve body 40 and the valve seat 41, allowing the refrigerant to flow between the right-hand refrigerant passage 37*a* and the left-hand refrigerant passage 37*b*.

On the other hand, when the atmospheric temperature is lowered and the refrigerant pressure in the header 30 is reduced, the force acting in the direction of closing the valve body 40 due to the atmospheric pressure acting on the bellows and the pressure setting spring 51 overcomes the force in the valve-opening direction, whereby the valve body 40 is seated onto the valve seat 41 to block off the refrigerant passage 37. The pressure at which the valve is opened and closed can be adjusted by an adjust screw 52. Specifically, when the adjust screw 52 is screwed in, the pressure setting spring 51 is contracted to increase the force acting to close the valve body 40. This requires the increased refrigerant pressure in the header 30 to open the valve body 40, with the result that a setting value of the valve opening and closing pressure can be increased. Conversely, when the adjust screw 52 is loosened, the force pushing down the valve body 40 is weakened and, therefore, the pressure in the header 30 necessary to push up the valve body 40 is reduced.

The above-described arrangement of this embodiment has an advantage of eliminating the need of such components as a sensor and an electric-powered valve driver circuit over the embodiment of the refrigerant flow rate control valve shown in FIG. 10.

FIG. 12 shows the refrigerant flow rate control valve 35 which is opened and closed dependent on the refrigerant temperature in the header 30. As with the embodiment of FIG. 10, the refrigerant flow rate control valve 35 of this embodiment has the partition 36 for separating the refrigerant passage 37 in the header 30, the valve body 40, and the valve seat 41. The present valve is however different therefrom in that a temperature-dependent expandable member 53 capable of extending and contracting dependent on temperatures is disposed in a position adapted to push up the valve body 40, and a return spring 47 is disposed in a position adapted to push down the valve body 40. Here, the temperature-dependent expandable member 53 is constituted by sealing off wax in the bellows or using a shape memory alloy. When the heat load is large and the refrigerant temperature in the header 30 is high, the temperature-dependent expandable member 53 is extended to push up the valve body 40. The refrigerant passage is thereby established between the valve body 40 and the valve seat 41, allowing the refrigerant to flow between the right-hand refrigerant passage 37*a* and the left-hand refrigerant passage 37*b*.

On the other hand, when the atmospheric temperature is lowered and the refrigerant temperature in the header 30 is also lowered, the temperature-dependent expandable member 53 is contracted and the valve body 40 is seated onto the valve sat 41 under the action of the return spring 47 to thereby block off the refrigerant passage 37. It is needless to say that by using various types of the temperature-dependent expandable member 53 which have their operating temperatures different from one another, the refrigerant flow rate control valve ca be provided which is opened and closed at different temperatures. The above arrangement of this embodiment has an advantage of reducing the valve size as compared with the embodiments shown in FIGS. 10 and 11.

Figure 13:
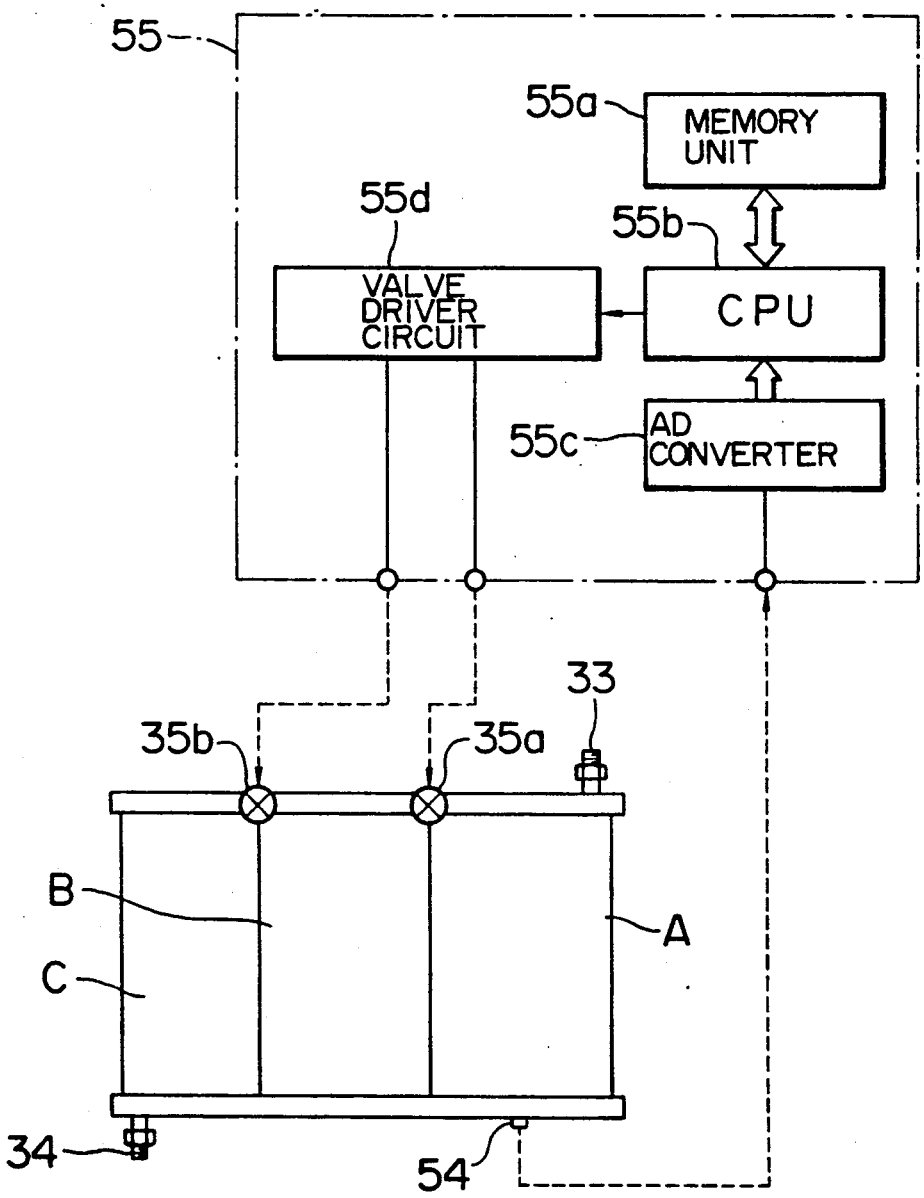
FIG. 13 is a block diagram showing a control circuit for passages in the condenser.
Figure 14:
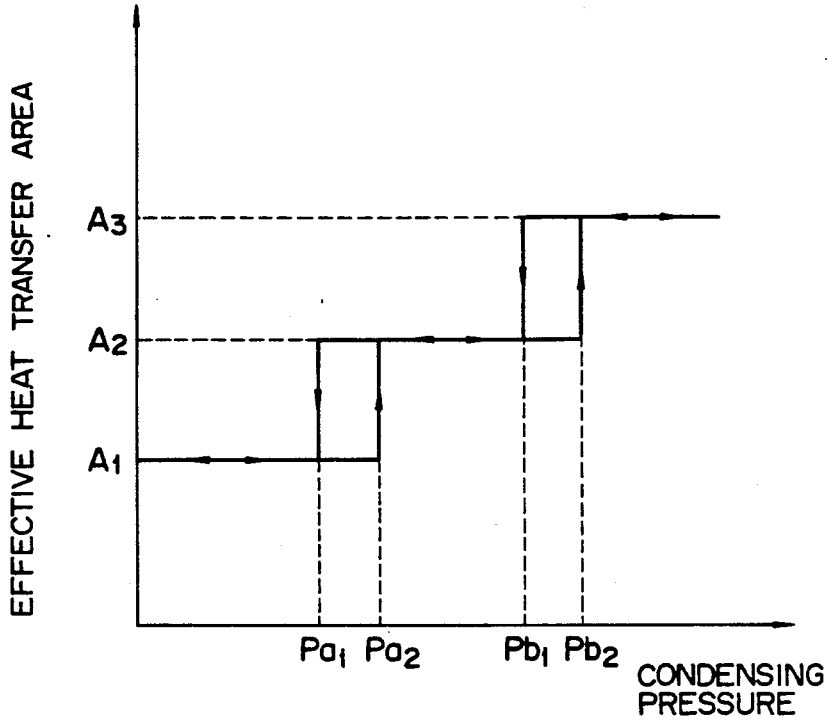
FIG. 14 is a graph for explaining a control method by the control circuit shown in FIG. 13.

A control method for the heat transfer area in the condenser thus arranged will be described below with reference to FIGS. 13 and 14, taking the condenser shown in FIG. 8 as an example. FIG. 13 diagrammatically shows an arrangement including a control circuit, and FIG. 14 shows changes in the effective heat transfer area versus the condensing pressure.

In the control method of this embodiment, as shown in FIG. 13, the refrigerant pressure or temperature in the heat exchanger is detected by a pressure (or temperature) sensor 5 and converted into a digital signal by an AD converter 55*c* in a controller 55. Based on that digital signal and an arithmetic control sequence previously stored in a memory unit 55*a*, a CPU 55*b* executes an arithmetic operation to output a signal to a valve driver circuit 55*d* which in turn outputs signals for opening and closing the first and second refrigerant flow rate control valves 35*a*, 35*b*.

Taking the case of using a pressure signal as an example, a control method effected by the controller 55 will now be explained with reference to FIG. 14 where the axis of abscissas represents the condensing pressure and the axis of ordinate represents the effective heat transfer area. When the atmospheric temperature is low and the condensing pressure is low, the first and second refrigerant flow rate control valves 35*a*, 35*b* are both closed. In this state, because only the section A of the heat exchanger is used, the effective heat transfer area is given by $A_1$. When the atmospheric temperature becomes higher and the condensing pressure is raised to exceed above $Pa_2$, the CPU 55*b* issues to the valve driver circuit 55*d* a control signal for opening the first refrigerant flow rate control valve 35*a*. Upon opening of the first refrigerant flow rate control valve 35*a*, the refrigerant is allowed to flow through the sections A and B to thereby give the effective heat transfer area of $A_2$. When the atmospheric temperature becomes still higher and the condensing pressure exceeds above $Pb_2$, the CPU 55*b* additionally issues to the valve driver circuit 55*d* a control signal for opening the second refrigerant flow rate control valve 35*b*, too. Upon opening of the second refrigerant flow rate control valve 35*b*, the refrigerant is allowed to flow through the sections A, B and C to thereby give the effective heat transfer area of $A_3$. Meanwhile, when the atmospheric temperature is lowered and the condensing pressure is reduced down to $Pb_1$, the CPU 55*b* issues a control signal for closing the second refrigerant flow rate control valve 35*b*. Closing of the second refrigerant flow rate control valve 35*b* results in the effective heat transfer area of $A_2$. Here, the pressure $Pb_1$ at which the second refrigerant flow rate control valve 35*b* is to be closed is set lower than the pressure $Pb_2$ at which the second refrigerant flow rate control valve 35*b* is to be opened. This hysteresis characteristic of the valve opening and closing signals is effective to prevent the controller 55 from hunting when the valve is switched over from an opened state to a closed state and vice versa. When the atmospheric temperature is further lowered and the condensing pressure is reduced down below $Pa_1$, the first refrigerant flow rate control valve 35*a* is closed to give the effective heat transfer area of $A_1$. Here, the pressure $Pa_1$ is also set lower than the pressure $Pa_2$ for the same reason as that the pressure $Pb_1$ is set lower than the pressure $Pb_2$ in the foregoing. It is needless to say that although the condensing pressure is selected as a control variable in this embodiment, the exactly equivalent operating effect can also be obtained by using a temperature sensor instead of the pressure sensor 54 and selecting the condensing temperature as a control variable. Another control method will be described below with reference to FIGS. 15 and 16.

Figure 15:
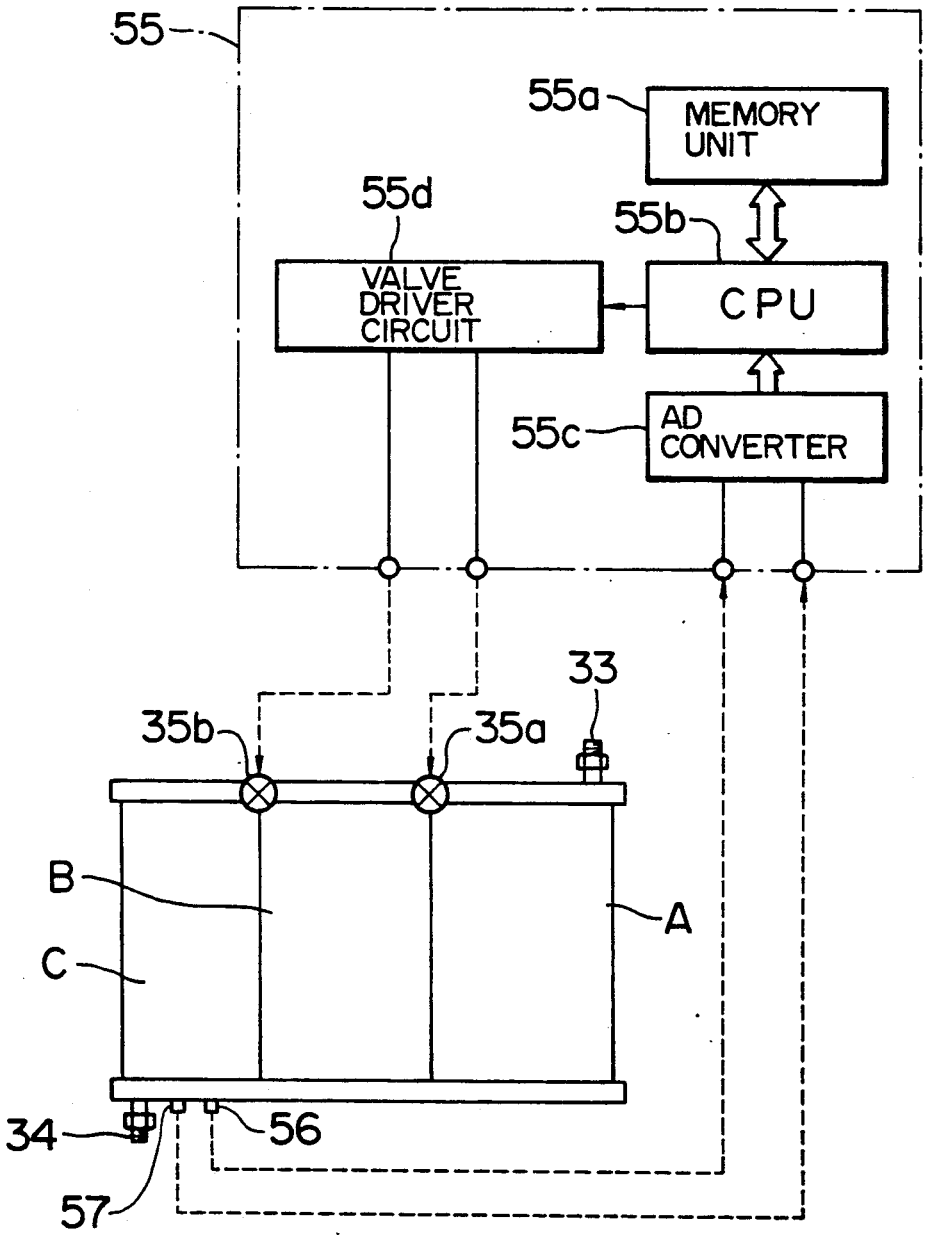
FIG. 15 is a block diagram showing another control circuit for passages in the condenser.

In the control method of this embodiment, the refrigerant pressure and temperature at the outlet of the heat exchanger are detected by a pressure sensor 56 and a temperature sensor 57, respectively, and the refrigerant flow rate control valves 35 are controlled based on the detected signals. One control process will now be explained by taking, as an example, the case of detecting a sub-cooled degree of the outlet refrigerant from the refrigerant pressure and temperature of the outlet of the heat exchanger, and opening and closing the refrigerant flow control valves 35 based on the detected value. Here, the term sub-cooled implies a state that the refrigerant is cooled below a saturation temperature corresponding to a certain pressure. The refrigerant is usually under the sub-cooled state at the condenser outlet. But, a reduction in the condenser capacity lowers the sub-cooled degree and, eventually, the refrigerant is brought into a two-phase state of gas and liquid. In general, the sub-cooled degree is represented by a difference between the saturation temperature corresponding to the refrigerant pressure at the condenser outlet and the temperature of the liquid refrigerant at the condenser outlet. As shown in FIG. 15, the refrigerant pressure and temperature are detected by the pressure sensor 56 and the temperature sensor 57 installed at the outlet of the heat exchanger, respectively. The detected signals are converted into digital signals by the AD converter 55*c*. Based on those digital signals and an arithmetic control sequence previously stored in the memory unit 55*a*, the CPU 54*b* calculates the sub-cooled degree. Valve opening and closing signals are sent to the refrigerant flow rate control valves 35 based on the calculated result for control of these valves.

Figure 16:
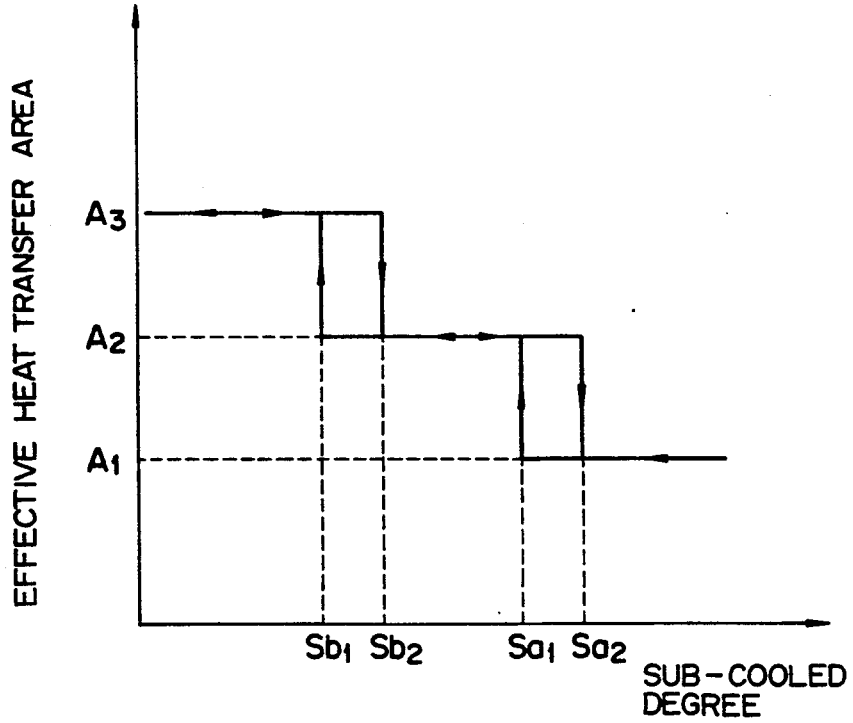
FIG. 16 is a graph for explaining a control method by the control circuit shown in FIG. 15.

Operation of the heat exchanger according to this embodiment will now be explained with reference to FIG. 16. In FIG. 16, the axis of abscissas represents the sub-cooled degree at the outlet of the heat exchanger and the axis of ordinate represents the effective heat transfer area. When the atmospheric temperature is low and the sub-cooled degree is large, the first and second refrigerant flow rate control valves 35*a*, 35*b* are both closed. In this state, because only the section A of the heat exchanger is used, the effective heat transfer area is given by $A_1$. When the atmospheric temperature becomes higher and the sub-cooled degree is reduced down below $Sa_1$, a command to open the first refrigerant flow rate control valve 35*a* is issued to the valve driver circuit 55*d* based on the signals detected and arithmetically processed by the CPU 55*a*. Upon opening of the first refrigerant flow rate control valve 35*a*, the refrigerant is allowed to flow through the sections A and B to thereby give the effective heat transfer area of $A_2$. When the atmospheric temperature becomes still higher and the sub-cooled degree is further reduced down below $Sb_1$, the CPU 55*b* additionally issues to the valve driver circuit 55*d* a command for opening the second refrigerant flow rate control valve 35*b*, too. Upon opening of the second refrigerant flow rate control valve 35*b*, the refrigerant is allowed to flow through the sections A, B and C to thereby give the effective heat transfer area of $A_3$. Meanwhile, when the atmospheric temperature is lowered and the sub-cooled degree is increased to exceed above $Sb_2$, the second refrigerant flow rate control valve 35*b* is closed to give the effective heat transfer area of $A_2$. When the atmospheric temperature is further lowered and the sub-cooled degree exceeds above $Sa_2$, the first refrigerant flow rate control valve 35*a* is closed to give the effective heat transfer area of $A_1$. Here, $Sa_2$ and $Sb_2$ are set larger than $Sa_1$ and $Sb_1$, respectively, so that the valve opening and closing signals are given with hysteresis characteristic to prevent the controller 55 from hunting, in a like manner to the embodiment shown in FIG. 14.

The advantageous effect obtainable with the above embodiment shown in FIG. 5 or FIG. 7 thus arranged will be described below by referring to FIG. 17 as compared with the prior art.

Figure 17:
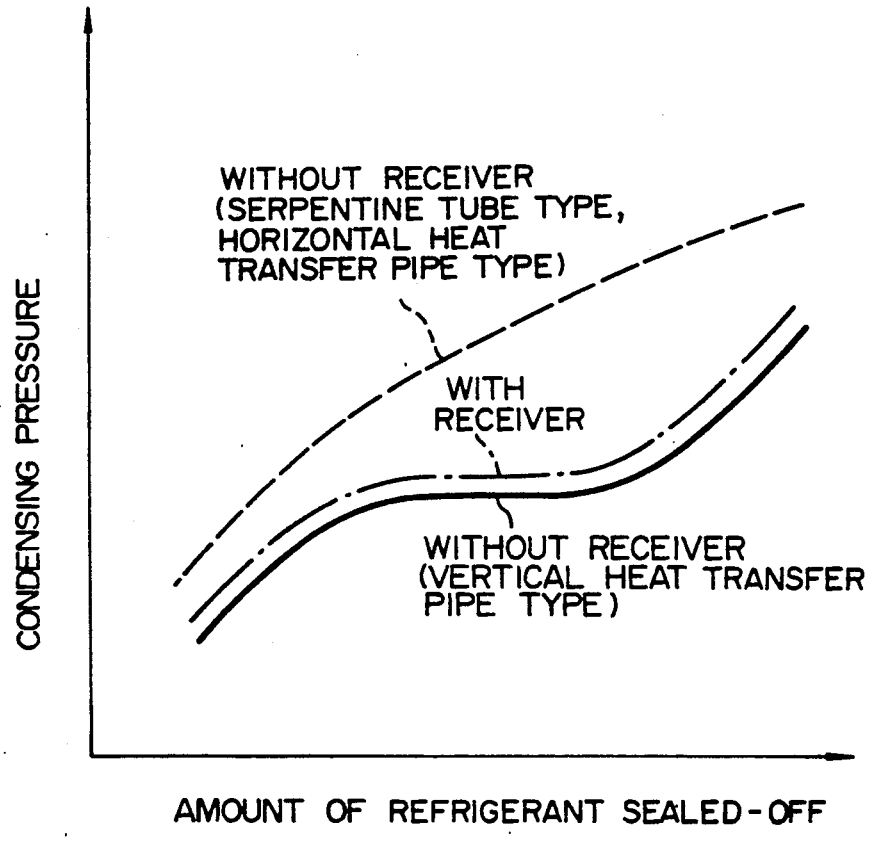
FIG. 17 is a graph for explaining an advantageous effect of the present invention.

FIG. 17 where the axis of abscissas represents an amount of refrigerant sealed off in the refrigerating cycle and the axis of ordinate represents a condensing pressure, shows change in the condensing pressure dependent on the amount of refrigerant sealed off. As the amount of refrigerant sealed off is gradually increased by assuming a rotational speed of the compressor 1, the atmospheric temperature, a wind speed in front of the condenser 2, as well as air intake conditions and an airflow rate of the evaporator 4 to be all constant, the condensing pressure is monotonously raised with an increase in the amount of refrigerant sealed off, as indicated by a broken line in FIG. 17, in the case of using condensers of serpentine tube type and horizontal heat transfer pipe type without receivers. On the other hand, when receivers are provided in those condensers, as indicated by a one-dot-chain line in FIG. 17, the condensing pressure is first monotonously raised with an increase in the amount of refrigerant sealed off. After a while, when the liquid refrigerant begins to accumulate in the receiver, the condensing pressure is not raised despite an increase in the amount of refrigerant sealed off. Thereafter, when the amount of refrigerant sealed off is continuously increased beyond such an extent that the receiver is filled with the liquid refrigerant, the condensing pressure is again monotonously raised with an increase in the amount of refrigerant sealed off. In the case of using the condenser 2 of vertical heat transfer pipe type that the heat transfer pipes 31 are arranged substantially in the direction of gravity, the liquid refrigerant is accumulated in the outlet header 30*b* and the lower portions of the heat transfer pipes 31, both of which can therefore also function as a receiver. As indicated by a solid line in FIG. 17, therefore, as the refrigerating cycle starts operating its function with an increase in the amount of refrigerant sealed off, the condensing pressure is first monotonously raised. After a while, when the liquid refrigerant begins to accumulate in the outlet header 30*b* and the lower portions of the heat transfer pipes 31, the condensing pressure is not raised despite an increase in the amount of refrigerant sealed off. This is attributable to no reduction in the heat transfer efficiency in a two-phase region due to the facts that the proportion of two-phase regions in the condenser which determines the condensing pressure is not changed until the outlet header 30*b* is filled with the liquid refrigerant, and that even after the liquid refrigerant begins to accumulate in the lower portions of the heat transfer pipes 31, the liquid refrigerant condensed in the two-phase region can smoothly flow down under the action of gravity because the heat transfer pipes 31 are arranged substantially in the direction of gravity. Thereafter, when the amount of refrigerant sealed off is continuously increased, the effect of reducing the heat transfer area in the two-phase region becomes greater than the effect of improving the heat transfer efficiency, the condensing pressure is again monotonously raised. Through the above process, the refrigerating cycle system using the condenser of vertical heat transfer pipe type can have the same function as the system which includes the receiver.

In the refrigerating cycle system having the receiver, it is required to increase the amount of refrigerant sealed off for the purpose of avoiding a shortage of the liquid refrigerant in the receiver and preventing refrigerant gas bubbles from flowing into the expansion valve 3 so as not to cause a hunting in the cycle. Therefore, the amount of refrigerant sealed off must be set to near an upper limit of a range of the sealed-off amount where the condensing pressure is held almost constant. Meanwhile, in the system where the heat exchanger of the embodiment shown in FIG. 5 or 7 is used as a condenser and the receiver is omitted, the condenser 2 also function as a receiver and, under a condition of the low atmospheric temperature, the outlet header 30*b* is filled with the liquid refrigerant to prevent refrigerant gas bubbles from flowing into the expansion valve 3 so as not to cause a hunting in the cycle. Accordingly, the amount of refrigerant sealed off can be set to near the upper limit of a range of the sealed-off amount where the condensing pressure is held almost constant as shown in FIG. 17, thereby making it possible not only to avoid a reduction in the sealed-off amount, but also to prevent a rise in the condensing pressure under a condition of the high atmospheric temperature. Moreover, by controlling the capacity of the heat exchanger dependent on the atmospheric temperature, a large amount of refrigerant will not be accumulated in the condenser 2 even under a condition of the low atmospheric temperature.

In short, the refrigerating cycle system can provide advantages of reducing the amount of refrigerant sealed off with omission of the receiver, preventing the expansion valve from causing a hunting under a condition of the low atmospheric temperature, and further preventing a rise in the condensing pressure under a condition of the high atmospheric temperature.

Figure 18:
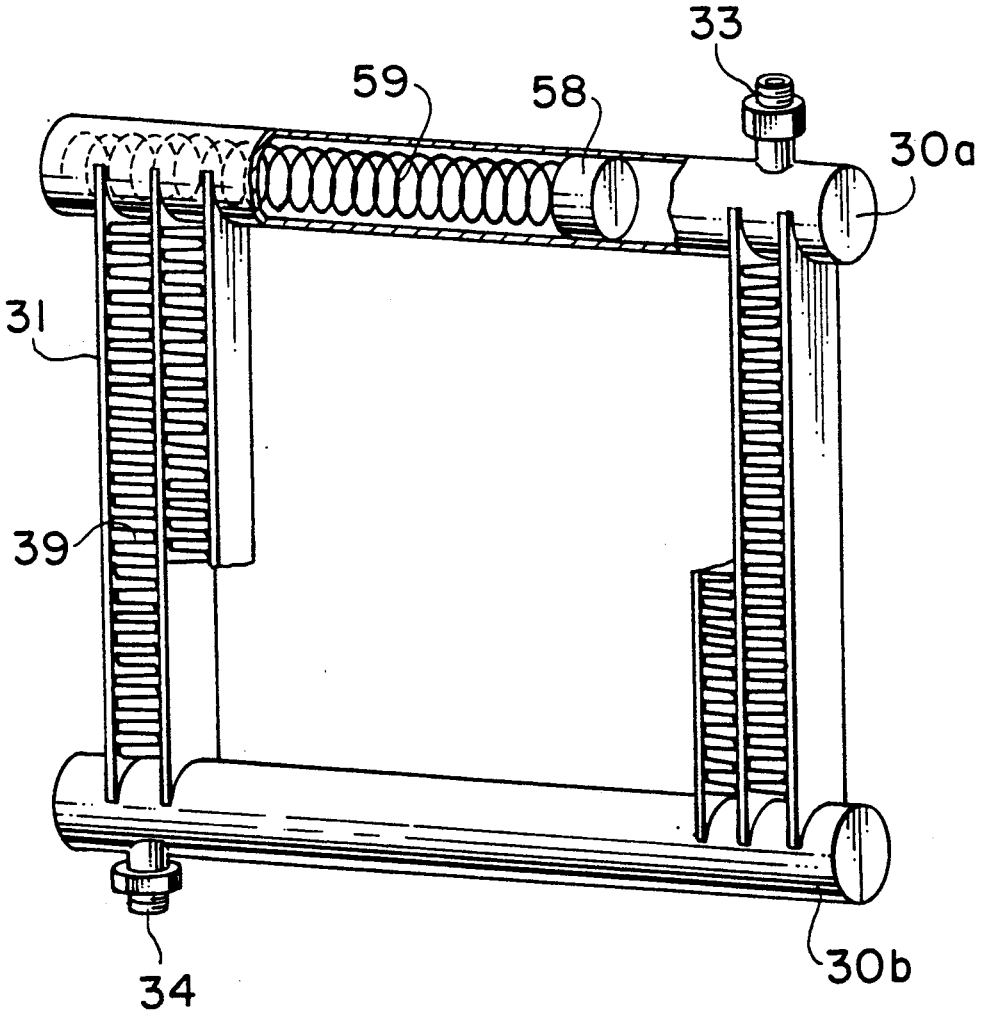
FIG. 18 is a perspective view showing an arrangement of a condenser of a fourth embodiment.

FIG. 18 shows a fourth embodiment of the present invention.

In this embodiment, the inlet header 30*a* is shaped into the form of a cylinder in which there are disposed a piston 58 and a spring 59 for normally urging the piston 58 toward the refrigerant inlet 33. When the heat load is large and the refrigerant pressure incoming from the refrigerant inlet 33 is high under such a condition as the high atmospheric condition, the refrigerant flows at a large flow rate and, therefore, the pressure loss of the refrigerant between the refrigerant inlet 33 and the refrigerant outlet 34 is increased when the refrigerant flows into from the refrigerant inlet 33, passes down through the heat transfer pipes 31 on the right side of the piston 58, and flows out from the refrigerant outlet 34 after passing through the outlet header 30*b*. Accordingly, the force due to the pressure acting in a region of the inlet header 30*a* rightwardly of the piston 58 on the same side as the refrigerant inlet 33 overcomes the sum of the force due to the pressure acting in a region of the inlet chamber 30*a* leftwardly of the piston 58 on the same side as the spring 59 and a resilient force of the spring 59 that tends to move the piston 58 rightwardly, thereby moving the piston leftwardly. As a result, the number of heat transfer pipes 31 through which the refrigerant incoming from the refrigerant inlet 33 can flow is increased, and so is the effective transfer area of the heat exchanger. On the other hand, when the atmospheric temperature is low, the flow rate of the refrigerant is decreased to reduce the pressure loss thereof between the refrigerant inlet 33 and the refrigerant outlet 34 for moving the piston 58 rightwardly. As a result, the number of heat transfer pipes 31 through which the refrigerant incoming from the refrigerant inlet 33 can flow is reduced, and so is the effective transfer area of the heat exchanger.

With this embodiment thus arranged, it is possible to change the effective heat transfer area substantially in a continuous manner.

Figure 19:
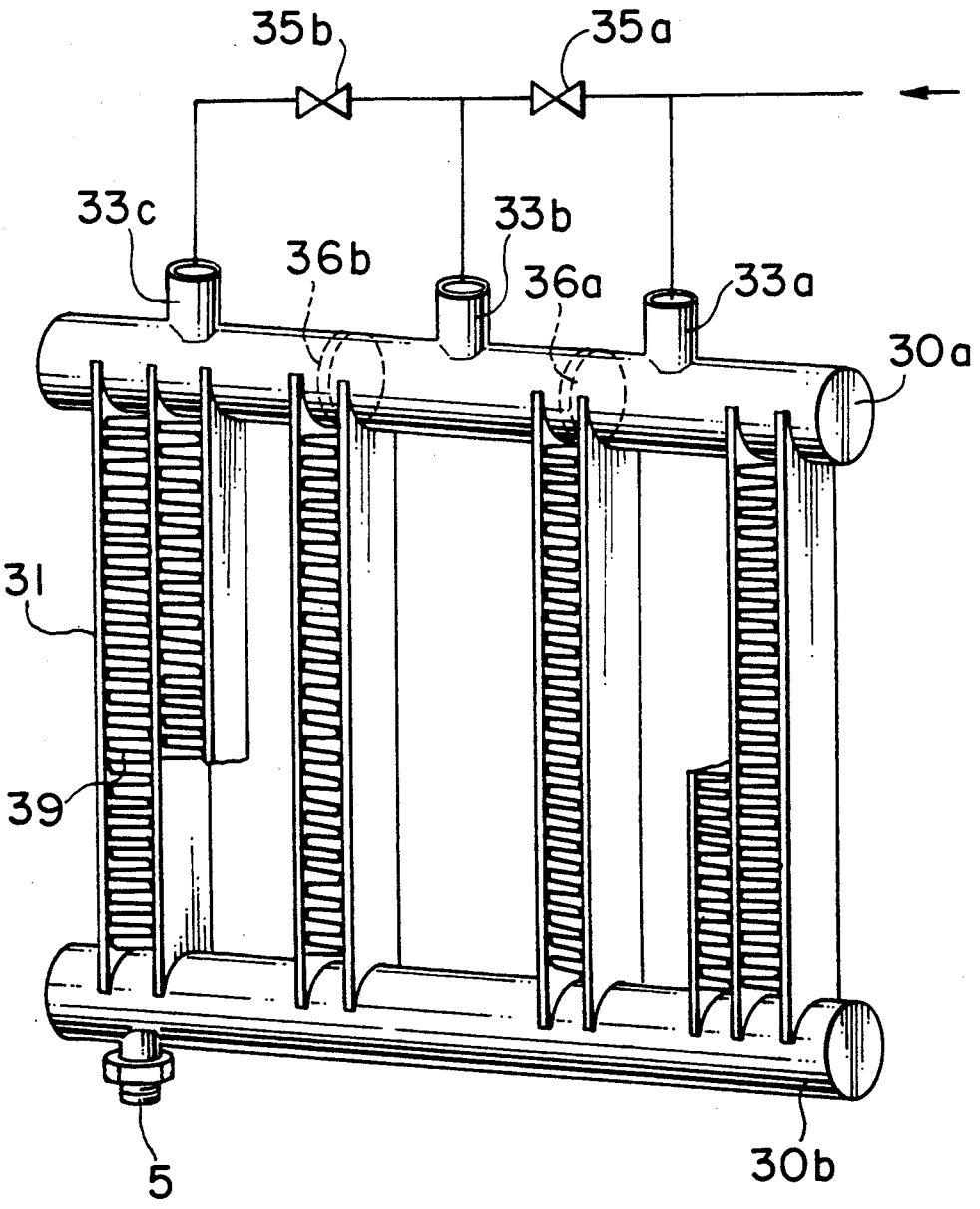
FIG. 19 is a perspective view showing an arrangement of a condenser of a fifth embodiment.

FIG. 19 shows a fifth embodiment of the present invention.

In this embodiment, the inlet header 30*a* is divided by first and second partitions 36*a*, 36*b* into three headers independently of one another, which are provided with first, second and third inlets 33*a*, 33*b*, 33*c*, respectively. The first and second refrigerant flow rate control valves 35*a*, 35*b* are each disposed between adjacent twos of the three inlets, so that the number of inlets through which the refrigerant can flow into the header(s) may be gradually increased and decreased. With this embodiment, when the first and second refrigerant flow rate control valves 35*a*, 35*b* are both opened, the refrigerant is allowed to flow into all of the inlets for maximizing the effective heat transfer area. Then, when the second refrigerant flow rate control valve 35*b* is closed, the refrigerant is allowed to flow into only the first and second inlets 33*a*, 33*b* for reducing the effective heat transfer area. Further, when the first refrigerant flow rate control valve 35*a* is closed, the refrigerant is allowed to flow into only the first inlet 33*a* for minimizing the effective heat transfer area.

This embodiment thus arranged is particularly advantageous for the case where an ample space is not reserved around the heat exchanger, because the refrigerant flow rate control valve can be provided separately from the inlet header.

Figure 20:
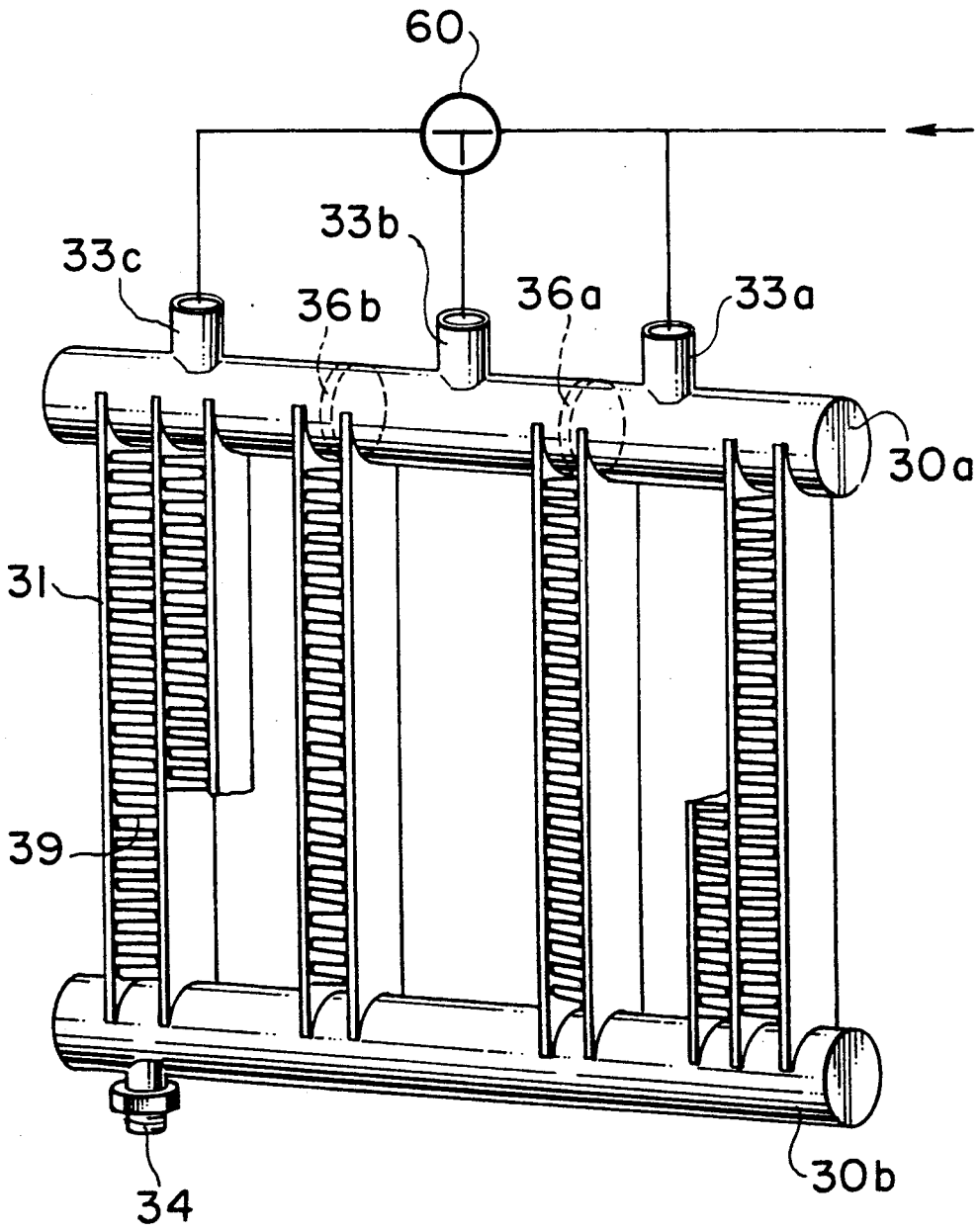
FIG. 20 is a perspective view showing an arrangement of a condenser of a sixth embodiment.
Figure 21:
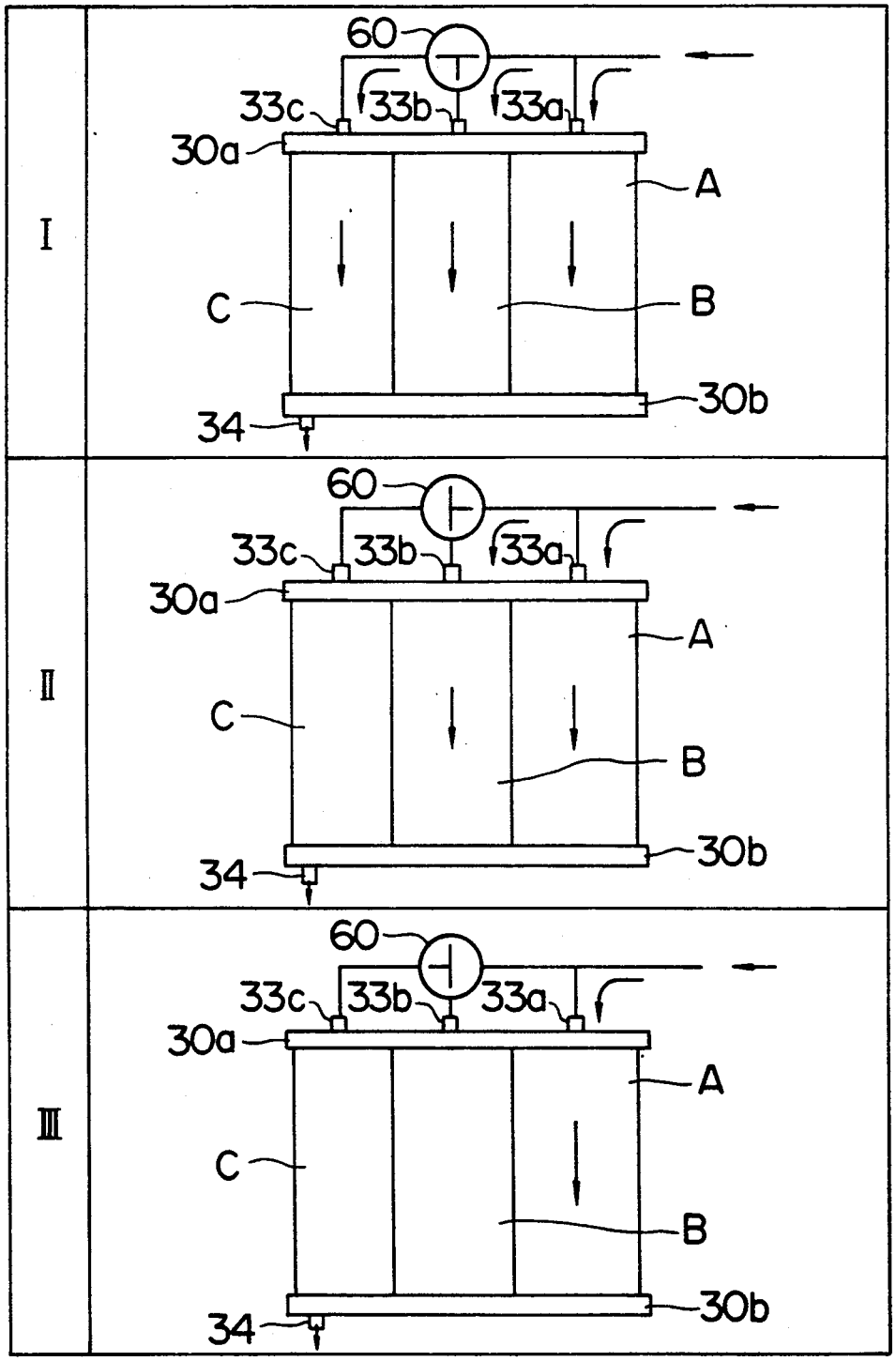
FIG. 21 is a set of diagrams showing changes in the heat transfer area and flows of a refrigerant in the condenser shown in FIG. 20.

FIGS. 20 and 21 show a sixth embodiment of the present invention.

This embodiment is different from the embodiment shown in FIG. 19 in that a three-way valve 60 is used instead of the first and second refrigerant flow rate control valves 35*a*, 35*b*. Operation of the three-way valve 60 will be explained by referring to FIG. 21. In a case (I), the three-way valve 60 is set to flow the refrigerant to both the second and third inlets 33*b*, 33*c* in addition to the first inlet 33*c*, so that the refrigerant is allowed to flow through all of the sections A, B and C for maximizing the effective heat transfer area. Then, in a case (II) where the three-way valve 60 is set to flow the refrigerant to only the second inlet 33*b* in addition to the first inlet 33*c*, the refrigerant is allowed to flow through the sections A and B so that the effective heat transfer area is given by an intermediate value. Further, when the three-way valve 60 is set as shown in a case (III), the refrigerant is allowed to flow through the sections A so that the effective heat transfer area is minimized.

With this embodiment thus arranged, it is possible to reduce the number of refrigerant flow rate control valves and achieve a space-saving.

Figure 23:
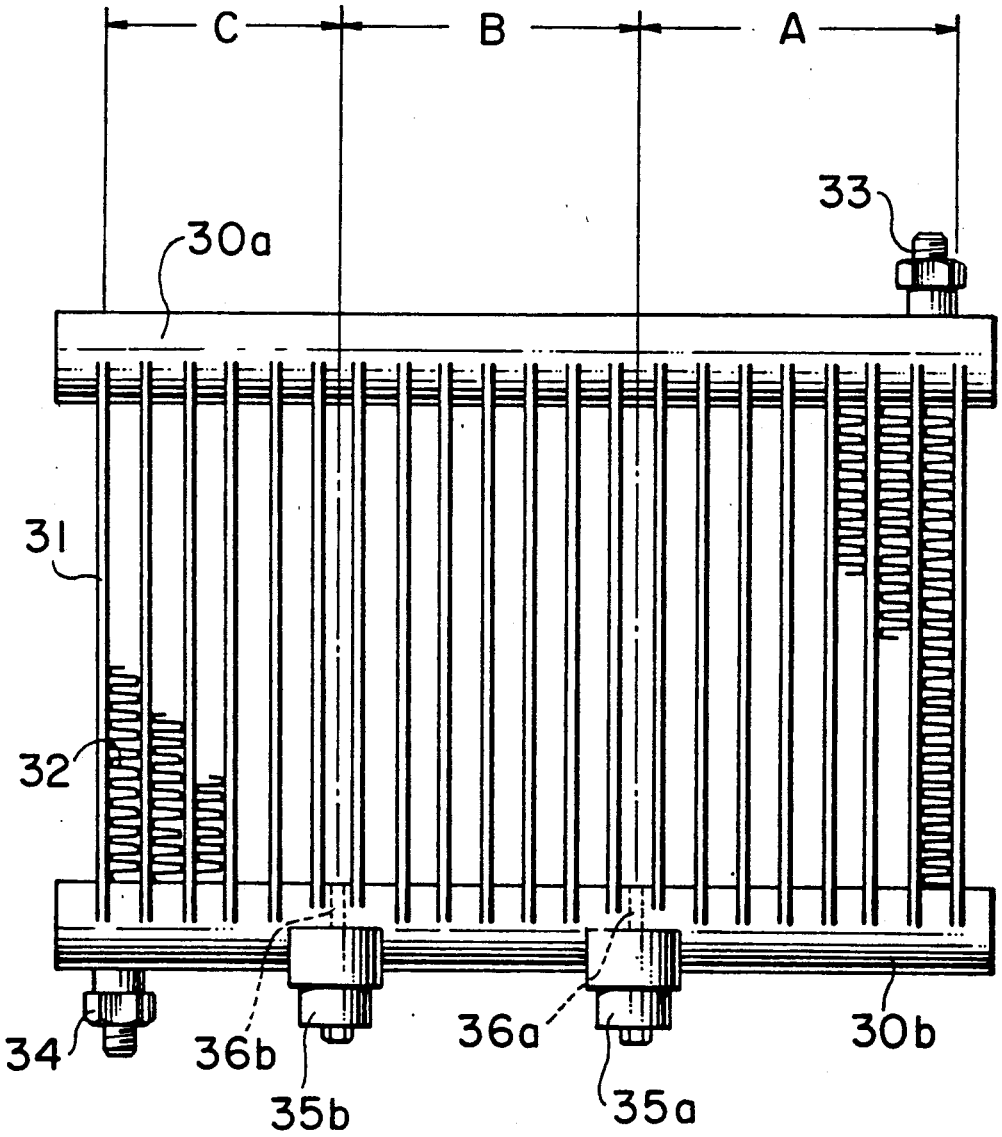
FIG. 23 is a front view showing an arrangement of a condenser of a seventh embodiment.
Figure 24:
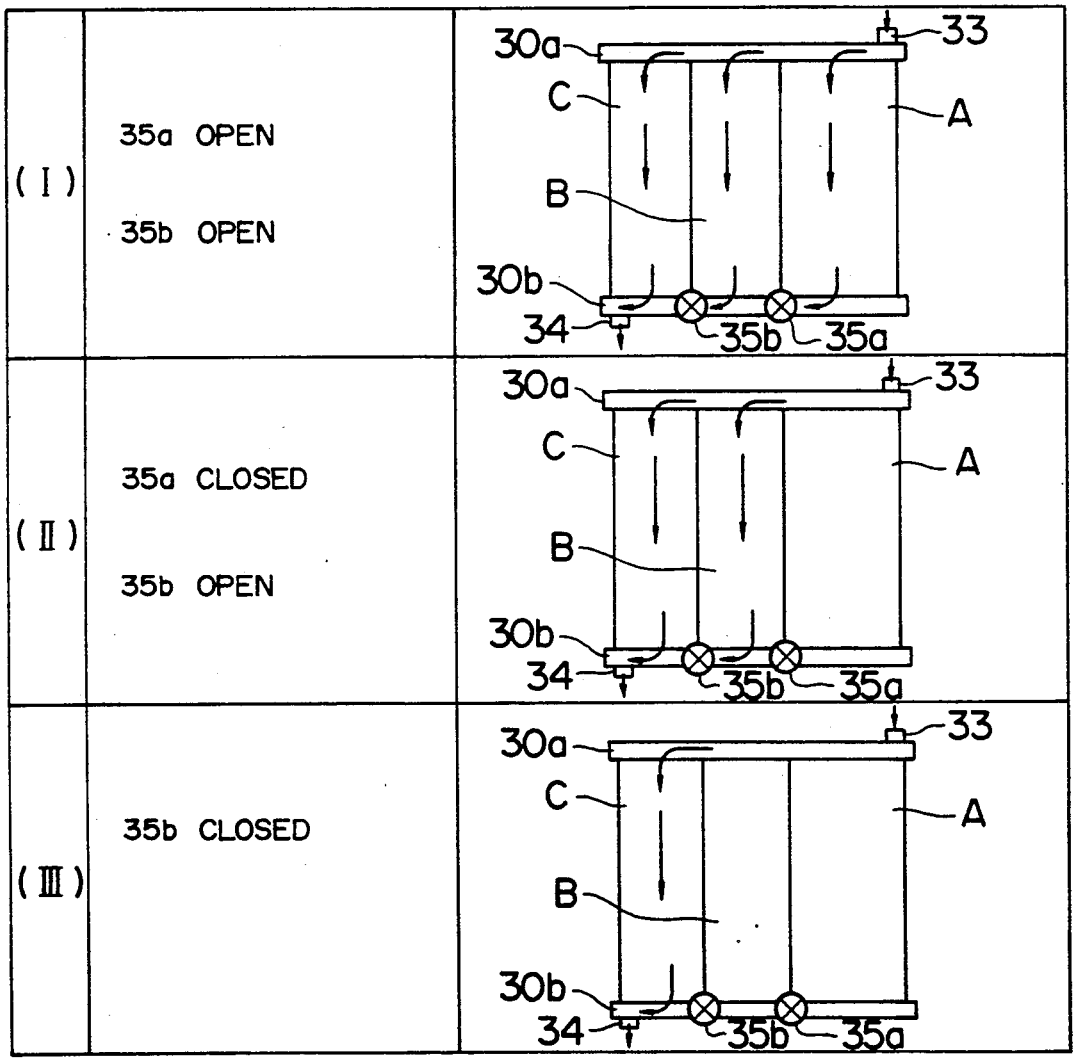
FIG. 24 is a set of diagrams showing changes in the heat transfer area and flows of a refrigerant in the condenser shown in FIG. 23.

FIGS. 23 and 24 show a seventh embodiment of the present invention. This embodiment is similar to the third embodiment shown in FIG. 8, but is different therefrom in that the first partition 36*a*, the first refrigerant flow rate control valve 35*a*, the second partition 36*b* and the second refrigerant flow rate control valve 35*b* are all provided in the outlet header 30*b*. The group of the heat transfer pipes is divided into three sections A, B and C similarly to the foregoing first, second and third embodiments. With the arrangement of this embodiment, however, because both the refrigerant flow rate control valves 35*a*, 35*b* are provided in the outlet header 30*b*, the refrigerant flow rate control valves 35*a*, 35*b* will not be exposed to high-temperature gas incoming from the compressor unlike the other embodiments, but are contacted with the condensed liquid at the relatively low temperature, resulting in the improved reliability of the control valves. Also, the condensed liquid exhibits a temperature nearly equal to the saturation temperature, and the temperature corresponds to the pressure in one-to-one relation. Therefore, this embodiment is especially suitable to the case of controlling the condensing pressure by using the control valve of type shown in FIG. 12 that is opened and closed upon detection of the temperature.

FIG. 24 shows the relationship of opened and closed states of the refrigerant flow rate control valves 35*a*, 35*b* with respect to flow patterns of the refrigerant through the heat transfer pipes 31. A case (I) corresponds to the sate that the first and second refrigerant flow rate control valves 35*a*, 35*b* are both opened, i.e., that the overheated gas refrigerant incoming from the refrigerant inlet 33 is distributed in the inlet header 30*a* to the respective heat transfer pipes and flows downwardly through the sections A, B, C while being cooled and condensed for liquefaction, followed by passing through the lower header 30*b* and flowing out through the refrigerant outlet 34. In this case, all of the sections A, B, C are used for heat exchange to maximize the effective heat transfer area. Further, the entire region of the outlet header 30*b* serves as a receiver so that the stable operation is enabled over a wide range of atmospheric temperatures. A case (II) corresponds to the state that the first refrigerant flow rate control valve 35*a* is closed and the second refrigerant flow rate control valve 35*b* is opened. In this case, only the sections B and C are used for heat exchange and, therefore, the effective heat transfer area becomes smaller than the case (I). A case (III) corresponds to the state that the second refrigerant flow rate control valve 35*b* is closed. In this case, only the section C takes part in heat exchange and the effective heat transfer area is further reduced. In this case (III), the first refrigerant flow rate control valve 35*a* may be either opened or closed. In the case of using the control valve of type shown in FIG. 12 which is opened and closed upon detection of the temperature, the first refrigerant flow rate control valve is just required to be set to have an operating temperature range higher than that of the second refrigerant flow rate control valve. It is needless to say that the partitions 36 and the refrigerant flow rate control valves 35 may be provided in the outlet header 30*b* in one pair, or three or more pairs.

By controlling the capacity of the condenser while changing its heat transfer area as explained above, the following advantageous effect is obtained.

In the refrigerating cycle using a conventional heat exchanger (condenser), when the atmospheric temperature is lowered particularly during traveling at a high speed, the discharge gas pressure of the compressor is too reduced to sufficiently tighten the main valve 21. Therefore, the evaporating pressure cannot be prevented from decreasing down below a predetermined value, resulting in that the evaporator surface is frosted or frozen. This is of course equally applied to a compressor of variable displacement type that the gas pressure acting on the back surface of the piston 9 is made higher than the gas pressure acting on the head of the piston 9 by directly introducing the discharge gas pressure of the compressor to the crank chamber 13 or by the use of blowby gas leaking into the crank chamber 13 through a gap between the piston 9 and the cylinder 8, and the journal 11 is rotated counterclockwise about the pivot 12 in FIG. 2 for reducing the capacity of the compressor.

Figure 22:
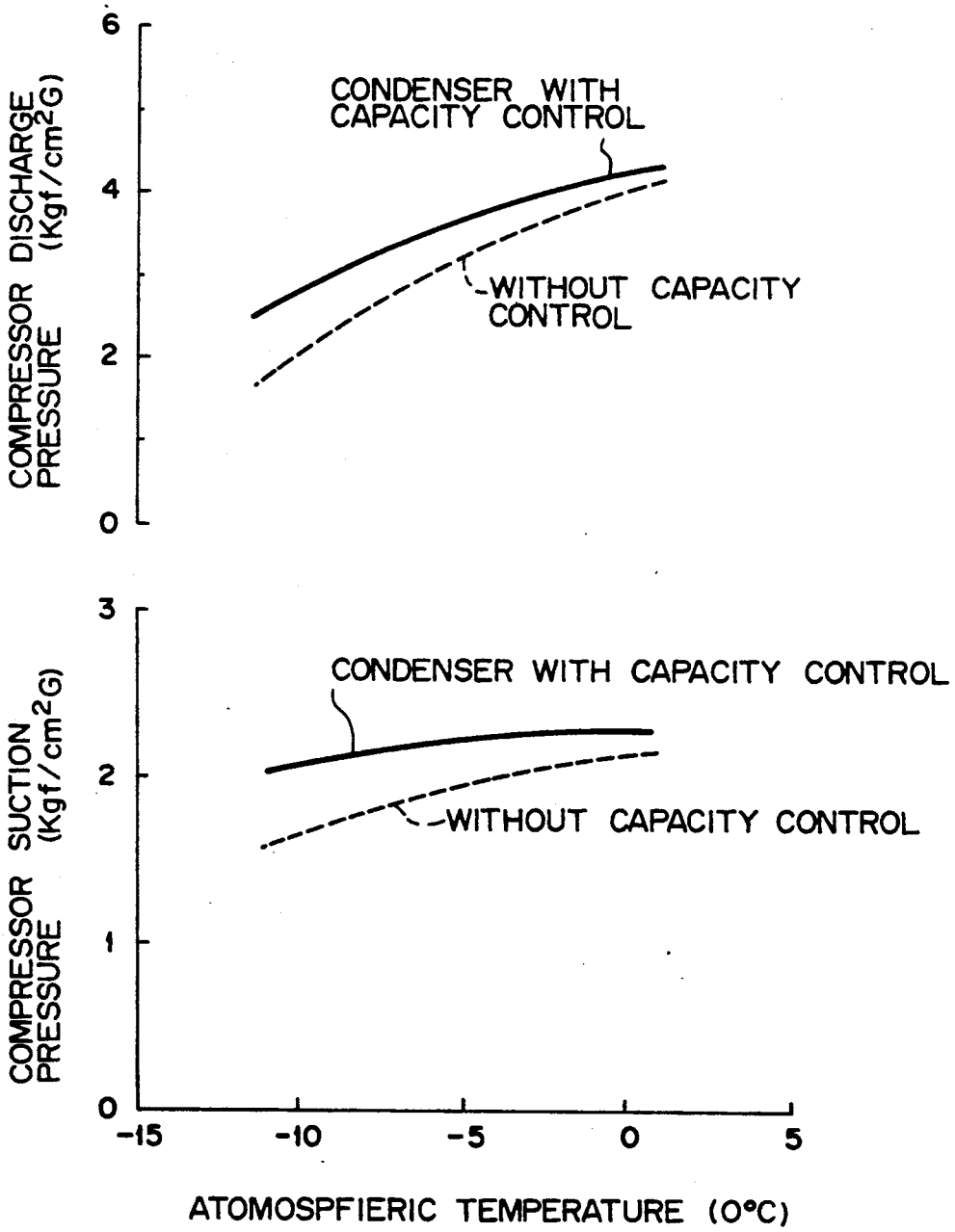
FIG. 22 is a set of graphs for explaining an advantageous effect of the present invention.

An example of test result run under the condition of the low atmospheric temperature when the heat exchanger of the present invention is applied as a condenser to the refrigerating cycle using a compressor of variable displacement type, is shown in FIG. 22 in which the axis of abscissas represents the atmospheric temperature and the axis of ordinate represents the delivery and suction pressures of the compressor. In FIG. 22, a solid line indicates the case of implementing capacity control of the condenser, whereas a broken line indicates the case of implementing no capacity control. As shown, in the case without capacity control, the delivery gas pressure of the compressor is so reduced that the compressor intake pressure becomes below 2 $kgf/cm^2G$ at the atmospheric temperature of $-5°$ C. In the system employing R12, this means that the evaporating pressure corresponds to a temperature below 0° C. and the evaporator surface is frosted or frozen. On the other hand, in the case of controlling the condenser capacity dependent on the atmospheric temperature, the discharge gas pressure of the compressor necessary for capacity control thereof can be reserved even at the atmospheric temperature of $-10°$ C. It is therefore possible to keep the compressor suction pressure above 2 $kgf/cm^2G$ and prevent the evaporator surface from being frosted or frozen even at that temperature.

Thus, the present invention can prevent the evaporating pressure in the evaporator 4 installed upstream of the compressor inlet 16 from decreasing down below a predetermined value, to thereby avoid frosting or freezing of the evaporator surface. Consequently, the compressor of variable displacement type that controls the capacity of the compressor by utilizing the discharge gas pressure thereof can be enlarged in its operating range.

It is needless to say that the foregoing description has been made by taking an air conditioning apparatus for automobiles as an example, the present invention is also applicable to other air conditioners for buildings or rooms as well.

The arrangements and advantages of the present invention can be summarized as follows. First of all, in a heat exchanger comprising a pair of headers disposed parallel to each other, a plurality of heat transfer pipes arranged to form refrigerant passages side by side between both the headers, and a number of fins disposed between every adjacent twos of the heat transfer pipes, either one or both of the headers of the heat exchanger is provided with at least one refrigerant flow rate control valve capable of opening and closing a refrigerant passage in the corresponding header. Therefore, the effective heat transfer area can be changed dependent on the atmospheric temperature. As a result, the liquid refrigerant will not be excessively accumulated in the condenser to prevent a two-phase flow of gas and liquid from flowing into an expansion valve, whereby the stable cycle operation can be achieved.

Secondly, by constituting the refrigerant flow rate control valve as an electric-powered valve capable of being opened and closed in response to an electric signal from the exterior, the refrigerant flow rate can be controlled accurately.

By controlling the electric-powered valve upon detection of the refrigerant pressure or temperature in the heat exchanger, or by detecting the refrigerant temperature and pressure at the outlet of the heat exchanger, making an arithmetic operation on detected values and controlling the electric-powered valve based on the resultant value, the capacity of the heat exchanger can be controlled dependent on the atmospheric temperature and heat load. Further, by using the present heat exchanger as a condenser for a refrigerating cycle system equipped with a compressor of variable displacement type that controls the capacity of the compressor by utilizing the discharge gas pressure thereof, the capacity control of the compressor can be performed even under a condition of the low atmospheric temperature, and the cycle can continue to run without freezing an evaporator. Alternatively, by constituting the refrigerant flow rate control valve to be opened and closed through utilization of the refrigerant temperature or pressure in the heat exchanger, an electric-powered valve driver circuit and a sensor can be dispersed with.

Thirdly, since the plurality of heat transfer pipes arranged to form the refrigerant passages side by side between the pair of headers disposed parallel to each other are oriented to extend substantially in the direction of gravity, not only the lower header and the lower portions of the heat transfer pipes also serve as a receiver, but also the condensed liquid can smoothly flow down under the action of gravity to improve the heat transfer efficiency. In addition, with the lower ends of the heat transfer pipes brought into a liquid-sealed state, the effective heat transfer area can be reduced positively when the refrigerant flow rate control valve is closed. As a result, it becomes possible to eliminate a receiver in the refrigerating cycle system for reducing the amount of refrigerant sealed off, and to prevent both a hunting of the expansion valve under a condition of the low atmospheric temperature and a rise in the condensing pressure under a condition of the high atmospheric temperature. Further, by shaping either one or both of the headers into the form of a cylinder and installing a piston within the cylinder to be movable, the effective heat transfer area of the heat exchanger can be changed in a substantially continuous manner.

What is claimed is:

1. An air conditioning apparatus comprising a compressor; a condenser connected to the discharge side of said compressor, said condenser being comprised of a pair of headers disposed parallel to each other and having refrigerant passages formed therein, a plurality of heat transfer pipes arranged between said headers to form refrigerant passages, a number of fins disposed in respective air passage spaces between adjacent pairs of said heat transfer pipes, and a refrigerant flow rate control valve for opening and closing the refrigerant passage in at least one of said headers; an expansion valve connected to the outlet side of said condenser; an evaporator connected between the outlet side of said expansion valve and the suction side of said compressor; and control means for controlling an opening and closing operation of said refrigerant flow rate control valve, wherein said refrigerant flow rate control valve is controlled by said control means to be opened and closed for changing the effective heat transfer area of said condenser.

2. An air conditioning apparatus comprising a compressor of variable displacement type; a condenser connected to the discharge side of said compressor, said condenser being comprised of a pair of headers disposed parallel to each other and having refrigerant passages formed therein, a plurality of heat transfer pipes arranged between said headers to form refrigerant passages, a number of fins disposed in respective air passage spaces between adjacent pairs of said heat transfer pipes, and a refrigerant flow rate control valve for opening and closing the refrigerant passage in at least one of said headers; an expansion valve connected to the outlet side of said condenser; an evaporator connected between the outlet side of said expansion valve and the suction side of said compressor; control means for controlling an opening and closing operation of said refrigerant flow rate control valve; and a temperature sensor for detecting an atmospheric temperature, wherein said refrigerant flow rate control valve is controlled by said control means to be opened and closed for reducing the effective heat transfer area of said condenser, when the atmospheric temperature detected by said temperature sensor is determined to be low.

3. An air conditioning apparatus according to claim 1 or 2, wherein said headers comprise an upper header and a lower header disposed in vertically spaced relation, said upper header has a refrigerant inlet, and said lower header has a refrigerant outlet.

4. An air conditioning apparatus according to claim 1 or 2, wherein said heat transfer pipes are arranged to extend substantially in the direction of gravity.

5. A control method for an air conditioning apparatus comprising a compressor; a condenser connected to the discharge side of said compressor, said condenser being comprised of a pair of headers disposed parallel to each other and having refrigerant passages formed therein, a plurality of heat transfer pipes arranged between said headers to form refrigerant passages, a number of fins disposed in respective air passage spaces between adjacent pairs of said heat transfer pipes, and a refrigerant flow rate control valve for opening and closing the refrigerant passage in at least one of said headers; an expansion valve connected to the outlet side of said condenser; an evaporator connected between the outlet side of said expansion valve and the suction side of said compressor; control means for controlling an opening and closing operation of said refrigerant flow rate control valve; and sensor means for detecting a refrigerant pressure or temperature on the outlet side of said condenser, wherein said refrigerant flow rate control valve is controlled by said control means to be opened and closed dependent on a signal value for changing the effective heat transfer area of said condenser.

6. A control method for an air conditioning apparatus according to claim 5, wherein the signal value detected by said sensor means is related to a temperature, and said refrigerant flow rate control valve is controlled to be opened and closed such that the lower said temperature, the smaller the effective heat transfer area of said condenser.

7. A control method for an air conditioning apparatus according to claim 5, wherein the signal value detected by said sensor means is related to a pressure and temperature, a sub-cooled degree is calculated from the signal values of pressure and temperature, and said refrigerant flow rate control valve is controlled to be opened and closed such that the larger said sub-cooled degree, the smaller the effective heat transfer area of said condenser.

8. A heat exchanger comprising a pair of headers disposed parallel to each other, a plurality of heat transfer pipes each having opposite ends inserted to said headers, respectively, and arranged to form refrigerant passages between said headers, and a number of fins disposed in respective air passage spaces between adjacent pairs of said heat transfer pipes, wherein either one or both of said headers is provided with at least one refrigerant flow rate control valve for opening and closing a refrigerant passage in the corresponding header, a refrigerant inlet of said heat exchanger is provided in one header, and a refrigerant outlet of said heat exchanger is provided in the other header.

9. A heat exchanger according to claim 8, wherein said plurality of heat transfer pipes are arranged to extend substantially in the direction of gravity.

10. A heat exchanger according to claim 8 or 9, wherein either one or both of said headers are shaped into the form of a cylinder, and a piston is movably installed in said cylinder.

11. A heat exchanger according to claim 8 or 9, wherein a plurality of partitions are provided in a refrigerant passage within the inlet header of said headers to divide said refrigerant passage into multiple headers independently of one another, so that flow rates of a refrigerant allowed to flow through said divided headers are adjusted individually.

12. A heat exchanger according to claim 8 or 9, wherein two partitions are provided in the inlet header of said headers to define three headers independently of one another, so that flow rates of a refrigerant allowed to flow through said three headers are adjusted by using a single three-way valve.

* * * * *